US009454147B1

(12) United States Patent
Friend et al.

(10) Patent No.: US 9,454,147 B1
(45) Date of Patent: Sep. 27, 2016

(54) CONTROL SYSTEM FOR A ROTATING MACHINE

(71) Applicant: Caterpillar Inc., Peoria, IL (US)

(72) Inventors: Paul Friend, Morton, IL (US); Michael Brandt, Racine, WI (US); Robert Hamann, Kenosha, WI (US); Paul E. Rybski, Pittsburgh, PA (US); Mark M. Smith, Burlington, WI (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/851,892

(22) Filed: Sep. 11, 2015

(51) Int. Cl.
*G06F 7/00* (2006.01)
*G05B 19/402* (2006.01)

(52) U.S. Cl.
CPC ... *G05B 19/402* (2013.01); *G05B 2219/45012* (2013.01)

(58) Field of Classification Search
None
See application file for complete search history.

(56) References Cited

U.S. PATENT DOCUMENTS

| | | | |
|---|---|---|---|
| 5,957,989 | A | 9/1999 | Egawa et al. |
| 6,032,093 | A | 2/2000 | Denbraber et al. |
| 6,108,949 | A | 8/2000 | Singh et al. |
| 6,170,681 | B1 | 1/2001 | Yoshimatsu |
| 6,282,477 | B1 | 8/2001 | Gudat et al. |
| 6,363,632 | B1 | 4/2002 | Stentz et al. |
| 6,766,600 | B2 | 7/2004 | Ogura et al. |
| 7,865,285 | B2 | 1/2011 | Price et al. |
| 8,315,789 | B2 | 11/2012 | Dunbabin et al. |
| 8,346,512 | B2 | 1/2013 | McAree |
| 8,768,579 | B2 | 7/2014 | Taylor et al. |
| 8,768,583 | B2 | 7/2014 | Hargrave, Jr. et al. |
| 8,886,416 | B2 | 11/2014 | Fukanao et al. |
| 8,898,000 | B2 | 11/2014 | Mcaree et al. |
| 9,097,344 | B2 * | 8/2015 | Hoff ..... E02F 3/342 |
| 2009/0043462 | A1 | 2/2009 | Stratton et al. |
| 2013/0088593 | A1 | 4/2013 | Ishimoto |
| 2014/0257647 | A1 | 9/2014 | Wu et al. |
| 2014/0270380 | A1 | 9/2014 | Morin |
| 2015/0355646 | A1 * | 12/2015 | Mochizuki ..... B60G 17/015 298/22 C |

FOREIGN PATENT DOCUMENTS

| | | | |
|---|---|---|---|
| EP | 2716821 | A1 | 4/2014 |
| KR | 2013-0041877 | A | 4/2013 |
| WO | WO 2011/021150 | A1 | 2/2011 |
| WO | WO 2014/192474 | A1 | 12/2014 |

* cited by examiner

*Primary Examiner* — Yolanda Cumbess
(74) *Attorney, Agent, or Firm* — Leydig, Voit & Mayer, Ltd.

(57) ABSTRACT

A system for setting a dump height of a material engaging work implement above a dump body includes a rotatable implement system, an implement system pose sensor, and a bed height sensor. A controller determines an initial bed height, determines an initial dump height, generates a command based upon the pose of the work implement, and determines a subsequent dump height higher than the initial dump height. The controller is further configured to position the work implement at the subsequent dump height, determine a further subsequent dump height higher than the subsequent dump height, and position the work implement at the further subsequent dump height over the dump body.

20 Claims, 12 Drawing Sheets

CONTROL SYSTEM FOR A ROTATING MACHINE

TECHNICAL FIELD

This disclosure relates generally to controlling a machine and, more particularly, to a control system for controlling movement of a work implement while performing rotational material moving operations.

BACKGROUND

Machines for moving material such as a rope shovels, mining shovels, excavators, and backhoes may be configured for rotational movement to move material between locations at a work site. For example, machines with such rotational capabilities may dig material at a first location such as a dig site with a material engaging work implement and rotate the work implement to a second location such as a dump site at which the work implement is dumped or unloaded.

The machines may operate in an autonomous or semi-autonomous manner to perform these tasks in response to commands generated as part of a work plan for the machines. The machines may receive instructions in accordance with the work plan to perform operations at the work site, such as those related to mining, earthmoving, construction, and other industrial activities.

The process of digging material at the first location and dumping material at the second location may be repeated numerous times over the course of a desired time period. Control of such machines may be a complex task requiring a significant amount of skill on the part of an operator and may require the manipulation of multiple input devices. As an example, it is typically desirable to move the work implement in a consistent and controlled manner along the desired path between the first location and the second location.

U.S. Pat. No. 5,968,104 discloses a hydraulic excavator having an area limiting excavation control system. The area limiting excavation control system has a setting device permitting an operator to set an excavation area at which an end of a bucket is allowed to move. The area limiting excavation control system also includes angle sensors disposed at pivot points of a boom, an arm, and a bucket for detecting respective rotational angles and velocities thereof, a tilt angle sensor for detecting a tilt angle of the excavator's body in a fore/aft direction, and a pressure sensor for detecting a load pressure of the boom as it is moved upward in response to signals generated by a control lever.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a system for setting a dump height of a material engaging work implement above a dump body includes a rotatable implement system at a work site having a linkage assembly and the work implement, an implement system pose sensor for generating implement system pose signals indicative of a pose of the implement system including a pose of the work implement, the dump body has a lower surface defining an initial bed height onto which material is dumped from the work implement, and a bed height sensor for generating bed height signals indicative of a bed height of the dump body. A controller is configured to store a relative dump height, determine an initial bed height based upon the bed height signals while the dump body is empty, determine an initial dump height at which the work implement is to be positioned over the dump body based upon the initial bed height and the relative dump height, generate a command based upon the pose of the work implement to position the work implement at the initial dump height over the dump body and dump material into the dump body, and determine a subsequent dump height, the subsequent dump height being higher than the initial dump height. The controller is further configured to generate a command based upon the pose of the work implement to position the work implement at the subsequent dump height over the dump body and dump material into the dump body, determine a further subsequent dump height with the further subsequent dump height being higher than the subsequent dump height, and generate a command based upon the pose of the work implement to position the work implement at the further subsequent dump height over the dump body and dump material into the dump body.

In another aspect, a controller implemented method of setting a dump height of a material engaging work implement above a dump body includes storing a relative dump height, determining an initial bed height based upon bed height signals from a bed height sensor while the dump body is empty, determining an initial dump height at which the work implement is to be positioned over the dump body based upon the initial bed height and the relative dump height, generating a command based upon a pose of the work implement to position the work implement at the initial dump height over the dump body and dump material into the dump body, and determining a subsequent dump height, the subsequent dump height being higher than the initial dump height. The method further includes generating a command based upon the pose of the work implement to position the work implement at the subsequent dump height over the dump body and dump material into the dump body, determining a further subsequent dump height with the further subsequent dump height being higher than the subsequent dump height, and generating a command based upon the pose of the work implement to position the work implement at the further subsequent dump height over the dump body and dump material into the dump body.

In still another aspect, a machine includes a rotatable base, a linkage assembly including a boom operatively connected to the rotatable base, a connecting member operatively connected to the boom, and a material moving work implement operatively connected to the connecting member, and an implement system pose sensor for generating implement system pose signals indicative of a pose of the implement system including a pose of the work implement. A dump body has a lower surface defining an initial bed height onto which material is dumped from the work implement and a bed height sensor for generating bed height signals indicative of a bed height of the dump body. A controller is configured to store a relative dump height, determine an initial bed height based upon the bed height signals while the dump body is empty, determine an initial dump height at which the work implement is to be positioned over the dump body based upon the initial bed height and the relative dump height, generate a command based upon the pose of the work implement to position the work implement at the initial dump height over the dump body and dump material into the dump body, and determine a subsequent dump height, the subsequent dump height being higher than the initial dump height. The controller is further configured to generate a command based upon the pose of the work implement to position the work implement at the subsequent dump height over the dump body and dump material into the dump body, determine a further subsequent dump height with the further subsequent dump height being higher than the subsequent dump height, and generate a command based upon the pose of the work implement to position the work implement at the further subsequent dump height over the dump body and dump material into the dump body.

DETAILED DESCRIPTION

Figure 1:
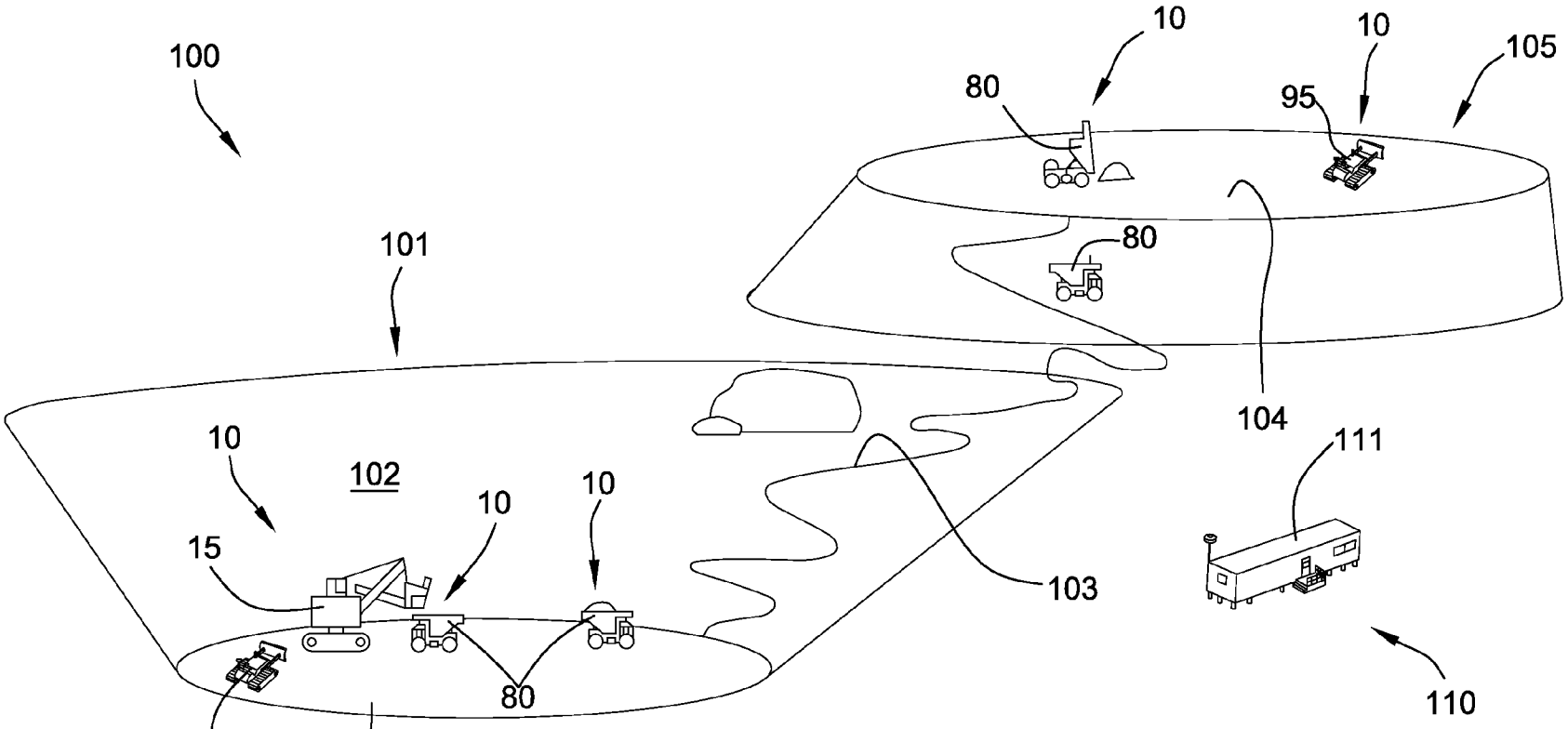
FIG. 1 depicts a schematic view of a work site at which a machine incorporating the principles disclosed herein may be used.

FIG. 1 depicts a diagrammatic illustration of a work site 100 at which one or more machines 10 may operate. Work site 100 may be a portion of a mining site, a landfill, a quarry, a construction site, a roadwork site, a forest, a farm, or any other area in which movement of machines is desired. As depicted, work site 100 includes an open-cast or open pit mine 101 having a face 102 from which material may be excavated or removed by a machine 10 such as a rope shovel 15 and loaded into a machine such as a haul truck 80. The haul trucks 80 are depicted as traveling along a road 103 to dump location at which the material is dumped. Machines 10 such as dozers 95 may move material along a ground surface 104 near the rope shovel 15 as well as near or towards a crest such as an edge of a ridge 105, embankment, high wall or other change in elevation. Face 102 and ground surface 104 may be collectively referred to herein as a work surface.

Figure 2:
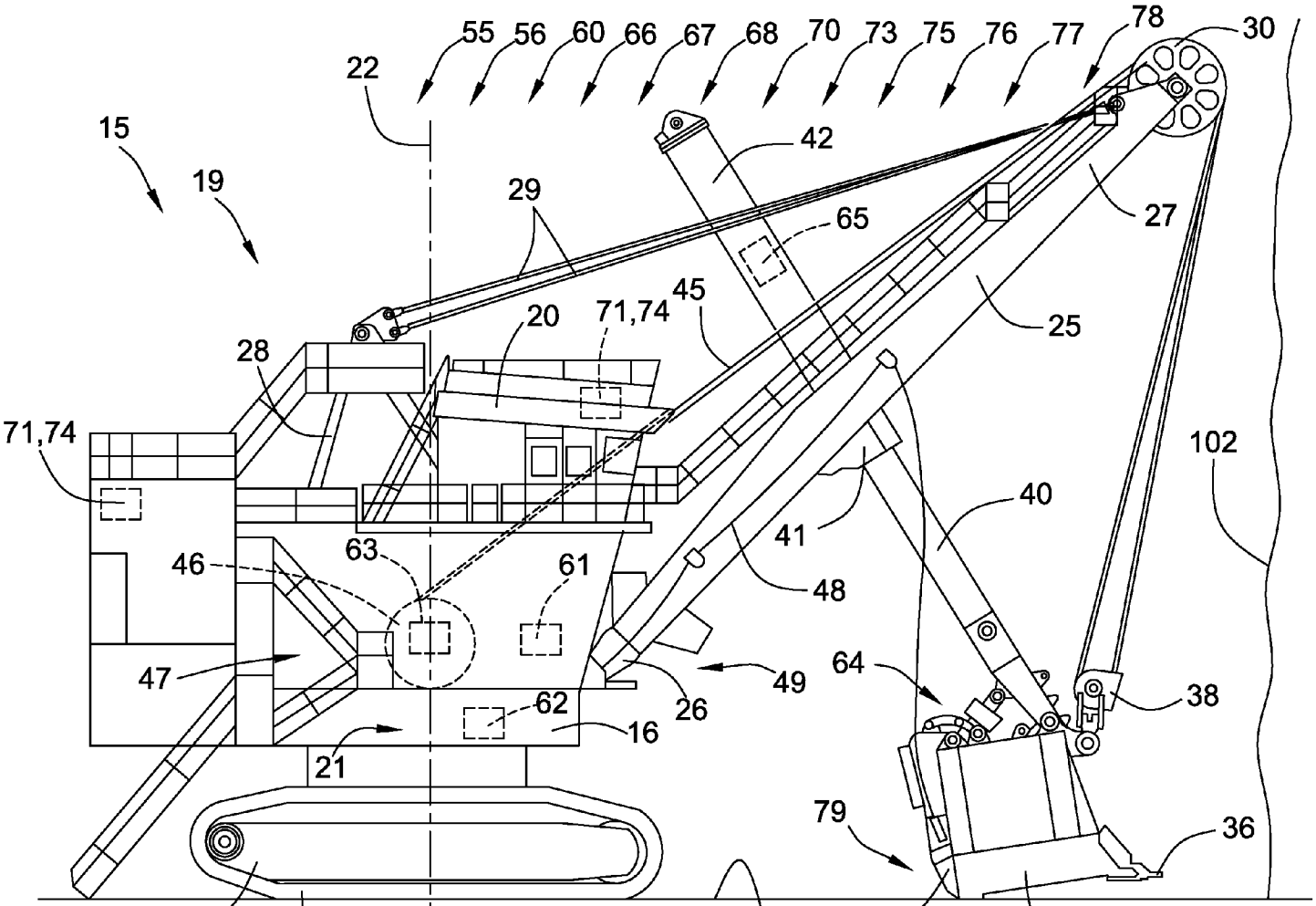
FIG. 2 depicts a diagrammatic illustration of a machine in accordance with the disclosure.

Referring to FIG. 2, an exemplary rope shovel 15 is depicted. Rope shovel 15 includes a platform or base 16 rotatably mounted on an undercarriage or crawler 17. The crawler 17 may include a ground engaging propulsion device such as a pair of tracks 18 that operate to propel and turn the rope shovel 15. Base 16 may include a power unit, indicated generally at 19 and an operator station 20. The power unit 19 provides or distributes electric and/or hydraulic power to various components of the rope shovel 15. A swing motor, indicated generally at 21, is operative to control the rotation of the base 16 relative to the crawler 17 about axis 22.

A linkage assembly or implement system may be mounted on the base 16 and includes a boom 25 having a lower or first end 26 operative connected, such as by being fixedly mounted, to the base 16. An A-frame 28 may be mounted on the based 16 and one or more support cables 29 may extend between the A-frame and an upper or second end 27 of the boom 25 to support the second end of the boom. A pair of spaced apart sheaves 30 may be mounted on the second end 27 of the boom 25.

The linkage assembly may further include a material engaging work implement such as a bucket or dipper 35 fixedly mounted to a connecting member or dipper handle 40. Dipper 35 may include a plurality of material engaging teeth 36 and a pivotable door 37 opposite the teeth to permit dumping or emptying of the dipper 35. At a first closed position, the door 37 retains material in the dipper 35 and at a second open position (FIG. 3), material may exit the dipper through the door.

A hoist cable 45 extends from a hoist drum 46 on base 16, is supported by sheaves 30 on the second end 27 of boom 25, and engages a bail or padlock 38 associated with the dipper 35. Extension or retraction of the hoist cable 45 through rotation of a hoist motor, indicated generally at 47, lowers or raises the height (i.e., the hoist) of the dipper 35 relative to a ground reference. Material within the dipper 35 may be released by opening the door 37 of the dipper through the use of an actuator cable 48 that extends between the door and an door actuator motor 49 on the base 16.

Dipper handle 40 is generally elongated and is operatively connected to the boom 25. More specifically, the dipper handle 40 is slidably supported within saddle block 41 and the saddle block is pivotably mounted on the boom 25. Extension or retraction (also referred to as "crowd") of the dipper handle 40 may be controlled by a crowd control mechanism operatively connected to the dipper handle and the saddle block 41. In one embodiment, the crowd control mechanism may include a double acting hydraulic cylinder 42 with one side of the hydraulic cylinder operatively connected to the dipper handle 40 and the other side operatively connected to the saddle block 41. The crowd of the dipper handle 40 may thus be controlled by the operation of the hydraulic cylinder 42. In a second embodiment (not shown), a crowd rope and a retract rope may be operatively connected to the dipper handle and routed around a crowd drum. Rotation of the crowd drum controls the crowd of the dipper handle 40. In a third embodiment (not shown), a rack may be mounted on dipper handle and a drive pinion mounted on the saddle block. In the second embodiment, the crowd of the dipper handle 40 may be controlled by operation of the pinion.

Rope shovel 15 may include an operator station 20 that an operator may physically occupy and provide input to control the machine. The operator station 20 may include one or more input devices (not shown) that an operator may utilize to provide input to a control system, indicated generally at 55, to control aspects of the operation of the rope shovel 15. The operator station 20 may also include a plurality of display devices (not shown) to provide information to an operator regarding the status of the rope shovel 15 and material moving operations.

Control system 55 may include an electronic control module or controller 56 and a plurality of sensors. The controller 56 may receive input signals from an operator operating the rope shovel 15 from within operator station 20 or off-board the machine through a wireless communications system 110 (FIG. 1). The controller 56 may control the operation of various aspects of the rope shovel 15 including positioning the dipper 35 and opening the door 37 of the dipper to dump a load of material.

The controller 56 may be an electronic controller that operates in a logical fashion to perform operations, execute control algorithms, store and retrieve data and other desired operations. The controller 56 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 56 such as power supply circuitry, signal conditioning circuitry, driver circuitry, and other types of circuitry.

The controller 56 may be a single controller or may include more than one controller disposed to control various functions and/or features of the rope shovel 15. The term "controller" is meant to be used in its broadest sense to include one or more controllers and/or microprocessors that may be associated with the rope shovel 15 and that may cooperate in controlling various functions and operations of the machine. The functionality of the controller 56 may be implemented in hardware and/or software without regard to the functionality. The controller 56 may rely on one or more data maps relating to the operating conditions and the operating environment of the rope shovel 15 and the work site 100 that may be stored in the memory of controller. Each of these data maps may include a collection of data in the form of tables, graphs, and/or equations.

The control system 55 and the controller 56 may be located on the rope shovel 15 and may also include components located remotely from the machine such as at a command center 111 (FIG. 1). The functionality of control system 55 may be distributed so that certain functions are performed at rope shovel 15 and other functions are performed remotely. In such case, the control system 55 may utilize a communications system such as wireless communications system 110 for transmitting signals between the rope shovel 15 and a system located remote from the machine.

Rope shovel 15 may be equipped or associated with a plurality of sensors that provide data indicative (directly or indirectly) of various operating parameters of the machine. The term "sensor" is meant to be used in its broadest sense to include one or more sensors and related components that may be associated with the rope shovel 15 and that may cooperate to sense various functions, operations, and operating characteristics of the machine.

A pose sensing system 60, as shown generally by an arrow in FIG. 2, may include a pose sensor 61 to sense the position and orientation (i.e., the heading, pitch, roll or tilt, and yaw) of the rope shovel 15 relative to the work site 100. The position and orientation of the rope shovel 15 are sometimes collectively referred to as the pose of the machine.

The pose sensor 61 may include a plurality of individual sensors that cooperate to generate and provide pose signals to controller 56 indicative of the position and orientation of the rope shovel 15. In one example, the pose sensor 61 may include one or more sensors that interact with a positioning system such as a global navigation satellite system or a global positioning system to operate as a pose sensor. In another example, the pose sensor 61 may further include a slope or inclination sensor such as pitch angle sensor for measuring the slope or inclination of the rope shovel 15 relative to a ground or earth reference. The controller 56 may use pose signals from the pose sensors 61 to determine the pose of the rope shovel 15 within work site 100. In other examples, the pose sensor 61 may include a perception based system, or may use other systems such as lasers, sonar, or radar to determine all or some aspects of the pose of rope shovel 15.

If desired, the pose sensing system 60 may include distinct position and orientation sensing systems. In other words, a position sensing system (not shown) may be provided for determining the position of the rope shovel 15 and a separate orientation sensing system (not shown) may be provided for determining the orientation of the machine.

One or more implement sensors may be provided to monitor the position and status of the dipper 35. More specifically, sensors may be provided to provide signals indicative of the position and other characteristics of the dipper 35. A swing sensor 62 may be provided that generates swing signals indicative of the angle of the base 16 relative to the crawler 17. In one example, the pose sensing system 60 may determine the pose of the base 16 and the swing sensor 62 may determine the angle of the crawler 17 relative to the base.

A hoist sensor 63 may be provided that generates hoist signals indicative of the height of the dipper 35 relative to the base 16. The hoist signals may be based upon the position of the hoist cable 45, the hoist drum 46, and/or the hoist motor 47. A door sensor 64 may be provided that generates door signals indicative of the status (i.e., open or closed) of the door 37 of the dipper 35. A crowd sensor 65 may be associated with the boom 25, dipper handle 40, and/or saddle block 41. The crowd sensor 65 may be configured to generate crowd signals indicative of the crowd or position (i.e., the extension or retraction) of the dipper handle 40 relative to the boom 25.

Each of the sensors may embody any desired structure or mechanism. While described in the context of position sensors that may be used to determine the relative positions of the base 16, crawler 17, dipper 35, and dipper handle 40, some or all of the sensors may use another frame of reference such as a global navigation satellite system or a global positioning system. For example, one or more sensors may be similar to the pose sensor 61 and determine positions relative to an earth or another non-machine based reference.

Additional sensors may be provided on the rope shovel 15 including a weight or load sensor indicated generally at 66 for determining the weight or load of material within the dipper 35, one or more inertial measurement units or acceleration sensors indicated generally at 67 for determining a rate of acceleration of various components of the rope shovel, and one or more inclination or pitch sensors 68 for determining the pitch of various components of the machine. In addition to determining information regarding the rope shovel 15 directly (e.g., by using acceleration sensor 67 to determine acceleration or using a pitch sensor 68 to determine pitch), the sensors may be used to determine additional information regarding the performance of the machine indirectly (e.g., by using the acceleration sensor to determine velocity or the pitch sensor to determine pitch rate).

The positions of the components of the rope shovel 15 including base 16, boom 25, dipper 35 and dipper handle 40 may be determined based upon the kinematic model of the rope shovel together with the dimensions of the base 16, crawler 17, dipper 35, and dipper handle 40, as well as the relative positions between the various components. More specifically, the controller 56 may include a data map that identifies the position of each component of the rope shovel 15 based upon the relative positions between the various components. The controller 56 may use the dimensions and the positions of the various components to generate and store therein a three-dimensional electronic map of the rope shovel 15 at the work site 100. In addition, by knowing the speed or acceleration of certain components, the speed or acceleration of other components of the rope shovel 15 may be determined.

The control system 55 may also include a terrain mapping system 70 positioned on or associated with rope shovel 15 to scan work site 100 and map the work surface surrounding the rope shovel as well as any obstacles at the work site. The terrain mapping system 70 may include one or more perception or perception sensors 71 (FIG. 4) that may scan work site 100 to gather information defining the work surface thereof. More specifically, perception sensors 71 may determine the distance and direction from the perception sensors 71 to points that define a mapped surface such as the work surface as well as obstacles at the work site 100. The field of view of each perception sensor 71 is depicted schematically at 72.

The obstacles may embody any type of object including those that are fixed or stationary as well as those that are movable or that are moving. Examples of fixed obstacles may include infrastructure, storage, and processing facilities, buildings, trees, and other structures and fixtures found at a work site 100. Examples of movable obstacles may include machines such as haul trucks 80, light duty vehicles (such as pick-up trucks and cars), personnel, and other items that may move about work site 100.

Figure 4:
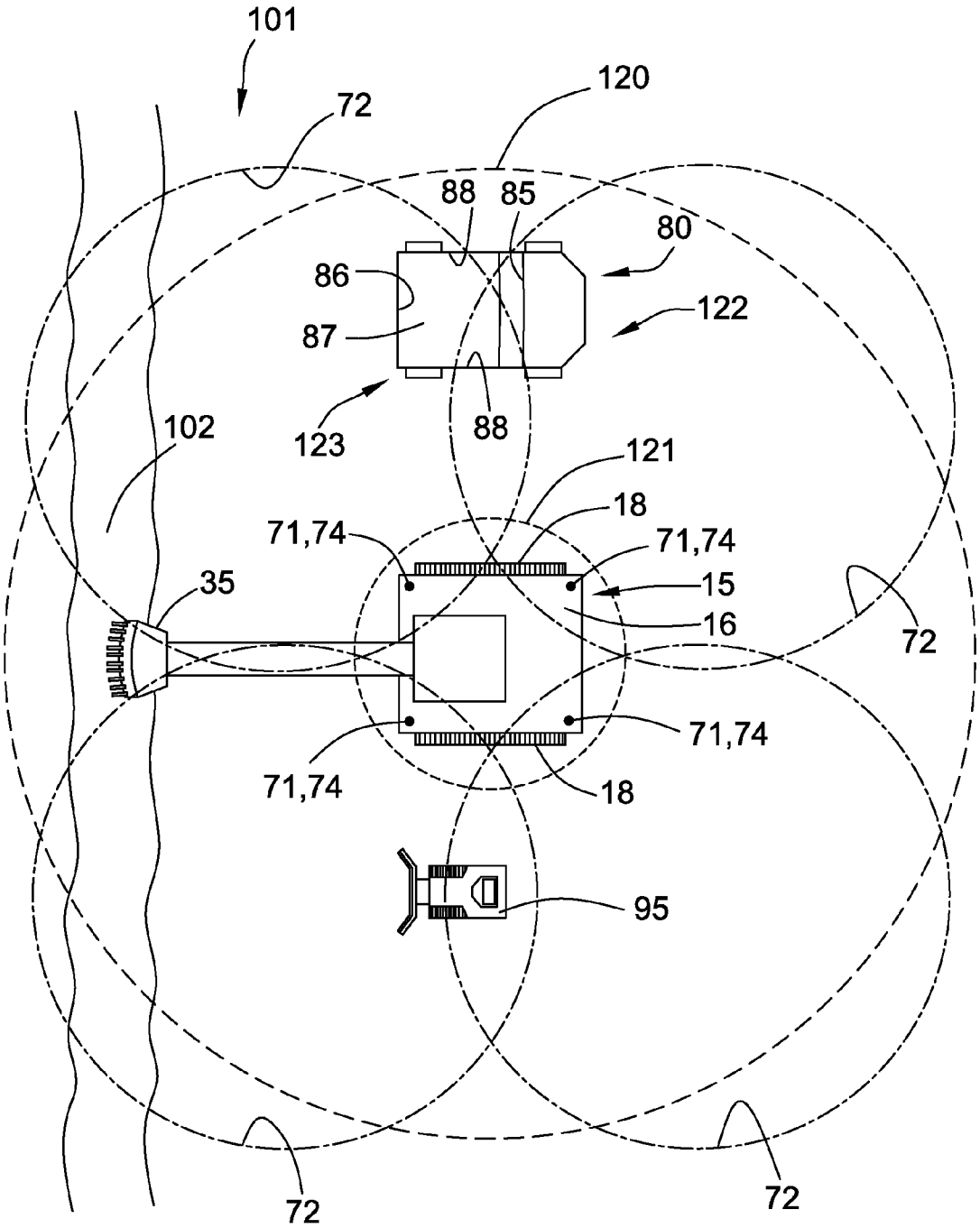
FIG. 4 depicts a schematic view of a portion of the work site of FIG. 1.

Mapping or perception sensors 71 may be mounted on rope shovel 15 such as at four corners of the machine as depicted in FIG. 4. In other examples, perception sensors 71 may be mounted at other locations on the rope shovel 15, on other machines, or mounted in fixed locations at the work site 100. Perception sensors 71 may embody LIDAR (light detection and ranging) devices (e.g., a laser scanner), RADAR (radio detection and ranging) devices, SONAR (sound navigation and ranging) devices, cameras, and/or other types of devices that may determine the range and direction to objects and/or attributes thereof. Perception sensors 71 may be used to sense the range, the direction, the color, and/or other information or attributes about detected objects and the work surface and generate mapping signals indicative of such sensed information and attributes.

An object identification system, shown generally at 73, may be mounted on or associated with the rope shovel 15 in addition to the terrain mapping system 70. In some instances, the terrain mapping system 70 and the object identification system 73 may be integrated together. Object identification sensors 74 may generate data that is received by the controller 56 and used by the controller to determine the type of obstacles detected by the object identification system 73. The object identification sensors 74 may be part of the perception sensors 71 and thus are depicted schematically as the same components in FIG. 4. In an alternate embodiment, the object identification sensors may be separate components from the perception sensors 71.

The sensed data generated by the perception sensors 71 may be used by the terrain mapping system 70 to generate an electronic three-dimensional terrain map of the work site 100. The terrain map may be overlaid or stored as a three-dimensional electronic map of the work site 100 and include the three-dimensional map of the rope shovel 15. In one example, the electronic map may be stored within controller 56 and/or an offboard controller.

The data or data points defining the electronic map of the work site 100 may be generated by the terrain mapping system 70 of rope shovel 15, by one or more machines having a terrain mapping system, or by a combination of the rope shovel and other machines. Regardless of the manner in which the electronic map is initially generated, data collected by the terrain mapping system 70 of the rope shovel 15 and/or other machines having terrain mapping systems may be subsequently used to update the electronic map.

Other or additional systems may be used to identify the position or location of obstacles at the work site 100 and generate data to be stored within the electronic map of the work site 100. In one example, machines at the work site 100 may each include a pose sensing system similar or identical to the pose sensing system 60 of rope shovel 15. For example, a plurality of haul trucks 80 may be operating at work site 100.

Figure 7:
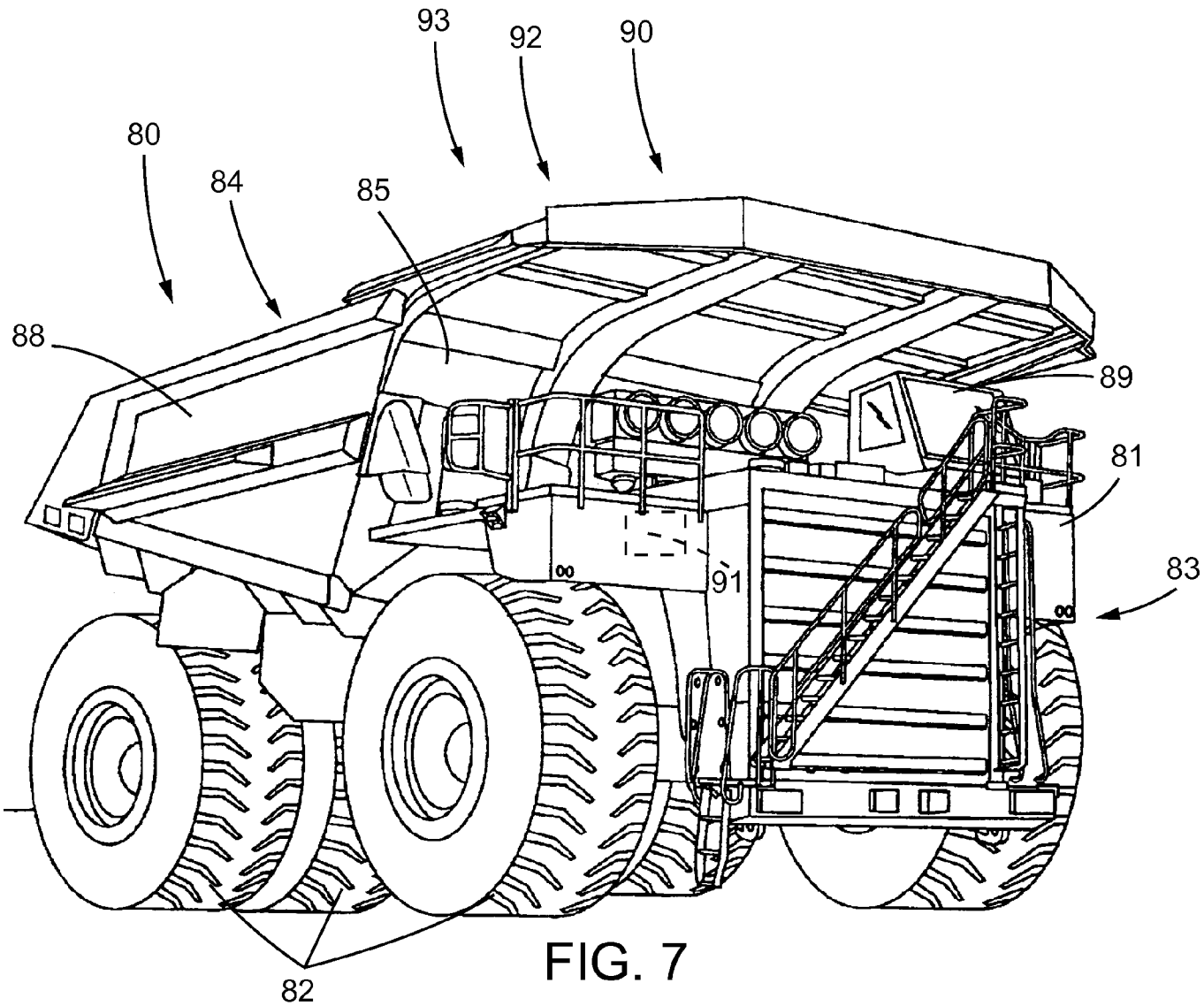
FIG. 7 depicts a diagrammatic illustration of a haul truck.

An example of a haul truck 80 is depicted in FIG. 7. Haul truck 80 may include a frame 81 supported by one or more traction devices 82 and a propulsion system for propelling the traction devices. The propulsion system may include a prime mover, as shown generally at 83, and a transmission (not shown) operatively connected to the prime mover. Haul truck 80 may include a pivotable dump body 84 into which material may be loaded and from which material may be subsequently dumped. Referring to FIG. 4, dump body includes a front wall 85, a rear wall 86, a lower surface 87, and a pair of opposite sidewalls 88 that extend between and connect the front and rear walls. A cab or operator station 89 may be included that an operator may physically occupy and provide input to operate the haul truck 80.

As with rope shovel 15, haul truck 80 may include a control system 90 and a controller 91 similar to those of rope shovel 15 and the descriptions thereof are not repeated. Haul truck 80 may include various systems and sensors for efficient operation of the machine such as a pose sensing system 92 generally similar to that of rope shovel 15 and a load sensing system generally indicated at 93 to sense the load or amount of material within the dump body 84.

The pose sensing system 92 of haul truck 80 may operate in a manner similar to pose sensing system 60 of rope shovel 15. The pose of the haul truck 80 may be communicated directly to the rope shovel 15 or to a remote system and the information entered or stored within the electronic map of the work site 100. Dimensions of the haul truck 80 may be determined or communicated and an electronic model of the truck may be added to the electronic map. In one embodiment, identifying information such as a code may also be transmitted from the haul truck 80 with the pose information.

A data map within controller 56, either at rope shovel 15 or at a remote location, may utilize the identifying code to determine the dimensions of the haul truck 80 and generate an electronic model of the haul truck based upon the pose of the truck and its dimensions. In another embodiment, the identifying information that accompanies the pose information may also include the dimensions of the truck. In still another embodiment, the dimensions of each type of machine that may be operating at the work site 100 may be stored within controller 56. For example, a list of potential haul trucks 80 that may be operating at the work site 100 together with their dimensions may be stored within controller 56. Upon determining that an obstacle is within a predetermined distance or proximity of the rope shovel 15, the object identification system 73 may identify the type of haul truck and utilize its stored dimensions to generate an electronic model that is stored within the electronic map.

Figure 5:
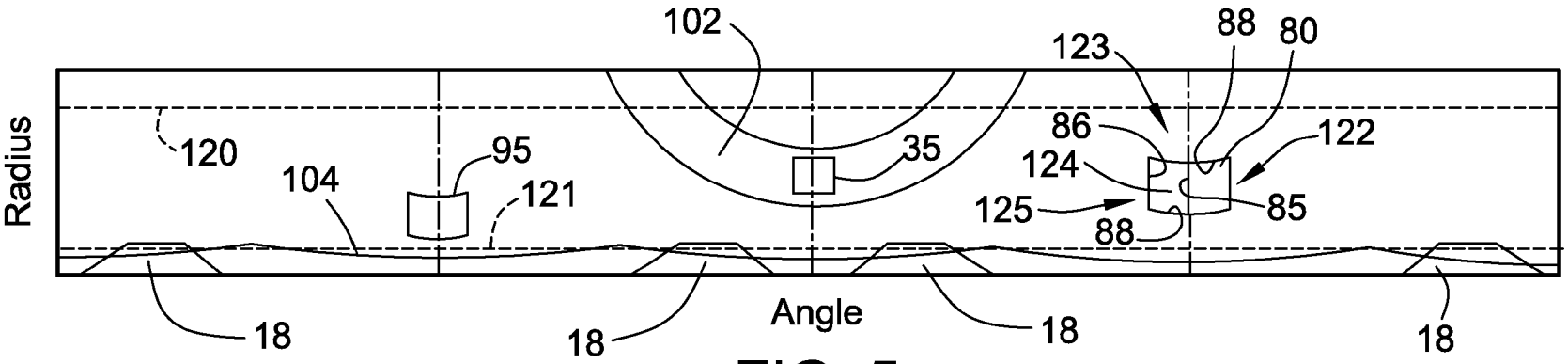
FIG. 5 depicts an exemplary graph of the portion of the work site of FIG. 4 plotting the radius as a function of angle in cylindrical coordinates.
Figure 6:
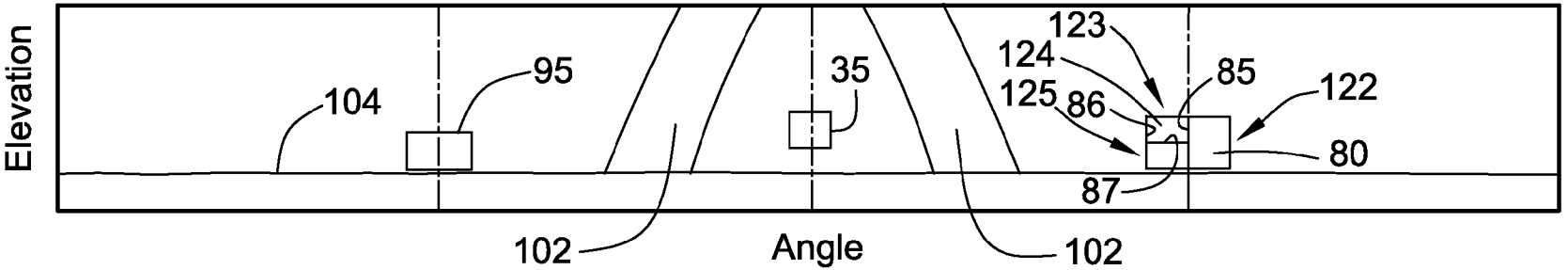
FIG. 6 depicts an exemplary graph similar to FIG. 5 but plotting the elevation as a function of angle in cylindrical coordinates.

The electronic map may be configured in any desired manner. In one example, the electronic map may be configured to store the data in a cylindrical coordinate system with the central axis of the cylindrical coordinate system corresponding to the axis 22 of the rope shovel 15. For example, referring to FIG. 4, a portion of work site 100 is depicted with rope shovel 15, haul truck 80, and dozer 95 adjacent a face 102 of the open pit mine 101. In FIGS. 5-6, the rope shovel 15, haul truck 80, dozer 95, and face 102 of FIG. 4 are depicted in a cylindrical coordinate system about axis 22 with the y-axis of FIG. 5 depicting the radius from the axis 22 and the y-axis of FIG. 6 depicting the elevation relative to a ground surface 104. In both instances, the x-axis depicts the position or angle about axis 22 and a horizontal position opposite the dipper 35 corresponding to both zero and 360 degrees.

Comparing FIG. 4 to FIGS. 5-6, one-to-one correspondence between many of the components, elements, or features of FIG. 4 may be found. For example, face 102 of the mine 101 is depicted in both FIGS. 5-6 and ground surface 104 is depicted as being slightly above the x-axis in both FIGS. 5-6 for clarity. The outer limit 120 of the reach of dipper 35 is depicted in FIGS. 4-5 but not in FIG. 6.

Dipper 35 is spaced from the axis 22 and thus is depicted above the x-axis in FIG. 5. Although not visible in FIG. 4, the dipper 35 is elevated above the ground surface 104 and thus is depicted in FIG. 6 above the ground surface.

Various obstacles adjacent the rope shovel 15 are also depicted in FIGS. 5-6. Portions of the base 16 may contact obstacles adjacent the rope shovel 15 while the rope shovel is rotating about axis 22. In addition, in some instances, it may be possible for the dipper 35 to contact the base 16. Accordingly, a keep-out zone 121 corresponding to an outer path of travel of the base 16 relative to axis 22 is depicted in FIGS. 4-5. The keep-out zone 121 is not depicted in FIG. 6. The tracks 18 may also be obstacles since it is possible for the dipper 35 to contact them under certain circumstances. The tracks 18 are depicted in FIGS. 4-5 but not in FIG. 6.

Haul truck 80 includes portions that are obstacles and also a portion that is a target zone for the dipper 35. More specifically, the forward portion of the haul truck 80, including the operator station 89, is depicted at 122. The rearward portion 123 of the haul truck may be divided into two sections with the dump body 84 depicted as the target zone 124 and the remainder as an obstacle 125. More specifically, the dump body 84 may be seen in FIGS. 4-6 as being defined by front wall 85, rear wall 86, lower surface 87, and sidewalls 88. As best seen in FIG. 5, the cylindrical coordinate boundaries of the target zone 124 are defined in one direction by sidewalls 88 that define the radial boundary, and in a perpendicular direction by the front wall 85 and rear wall 86 that define the circumferential boundary. The elevation component of the target zone 124 is defined by the lower surface 87 of the dump body 84 as well as the upper surfaces of the each of the front wall, 85, rear wall 86, and sidewalls 88.

Dozer 95 is depicted in FIG. 5 as an obstacle spaced from the axis 22 and has a height beginning at ground surface 104.

Rope shovel 15 may be configured to be operated autonomously, semi-autonomously, or manually. When operating semi-autonomously or manually, rope shovel 15 may be operated by remote control and/or by an operator physically located within the operator station 20. As used herein, a machine operating in an autonomous manner operates automatically based upon information received from various sensors without the need for human operator input. As an example, a haul truck that automatically follows a path from one location to another and dumps a load at an end point may be operating autonomously. A machine operating semi-autonomously includes an operator, either within the machine or remotely, who performs some tasks or provides some input and other tasks are performed automatically and may be based upon information received from various sensors. As an example, a haul truck that automatically follows a path from one location to another but relies upon an operator command to dump a load may be operating semi-autonomously. In another example of a semi-autonomous operation, an operator may dump a dipper or bucket of a rope shovel 15 or an excavator 200 (FIG. 12) into a haul truck 80 and a controller 56 may automatically return the dipper or bucket to a position to perform another digging operation. A machine being operated manually is one in which an operator is controlling all or essentially all of the functions of the machine. A machine may be operated remotely by an operator (i.e., remote control) in either a manual or semi-autonomous manner.

Control system 55 may include a module or planning system, indicated generally at 75 in FIG. 2, for determining or planning various aspects of a material moving operation. The planning system 75 may utilize various types of inputs from the sensors associated with the rope shovel 15 as well as the electronic map of the work site 100 including the configuration of the work surface, the position of the rope shovel, the position and movement of any obstacles adjacent the rope shovel, desired or proposed dig location(s), desired or proposed dump locations(s), and the characteristics of the material to be moved. Capabilities and desired operating characteristics and capabilities of the rope shovel 15 as well as its kinematic model may also be stored within controller 56 and used by the planning system 75. The planning system 75 may simulate and evaluate any aspect of a material moving operation, such as by evaluating a plurality of potential paths between the current location of the dipper 35 and a target zone, and then select (or provide feedback regarding) a proposed dig location, dump location, and/or the path between the dig location and the dump location that creates the most desirable results based upon one or more criteria.

One example of a desired operating characteristic, the controller 56 may be configured to minimize changes in direction such as only moving each of the swing, crowd, and hoist of the linkage assembly in a single direction during a material moving cycle or operation. In another example of a desired operating characteristic, the planning system 75 may be configured to avoid passing over any obstacles at the work site, if possible. In other words, while swinging the base 16 and the linkage assembly, the planning system 75 may move the dipper 35 and dipper handle 40 to a desired hoist and crowd, respectively, and continued to swing the dipper over the dump body 84 while generally maintaining the hoist until opening the door 37 of the dipper during the dumping process.

The planning system 75 may be utilized regardless of whether the rope shovel 15 is being operated autonomously, semi-autonomously, or manually. When operating the rope shovel 15 manually, the planning system 75 may provide suggestions for dig locations, dump locations, and paths therebetween. When operating autonomously or semi-autonomously, the planning system 75 may determine, and the controller 56 may generate, commands to direct the dipper 35 to the desired location or in a desired manner such as by controlling the rotation of the base 16 relative to the crawler 17, the movement of the dipper handle 40 relative to the boom 25, and the height of the dipper 35. Such commands may control both the speed and acceleration (and deceleration) of each type of movement of the rope shovel 15 (i.e., rotation, crowd, and hoist).

In view of the size of the rope shovel 15 and the large payloads that may be carried within the dipper 35, it may be difficult or even impossible to stop the rope shovel quickly. For example, rope shovel 15 may be a massive machine with a dipper 35 capable of carrying a payload of greater than 100 tons of material. Accordingly, the planning system 75 may generate a stopping zone 126 (FIGS. 5-6) within the electronic map through which components of the rope shovel 15 may travel by predicting the path or motion of the rope shovel based upon its speed, acceleration, and mass (including a payload) in the absence of additional inputs. In other words, the stopping zone 126 may identify an anticipated path of the machine based upon the machine's momentum.

Figure 8:
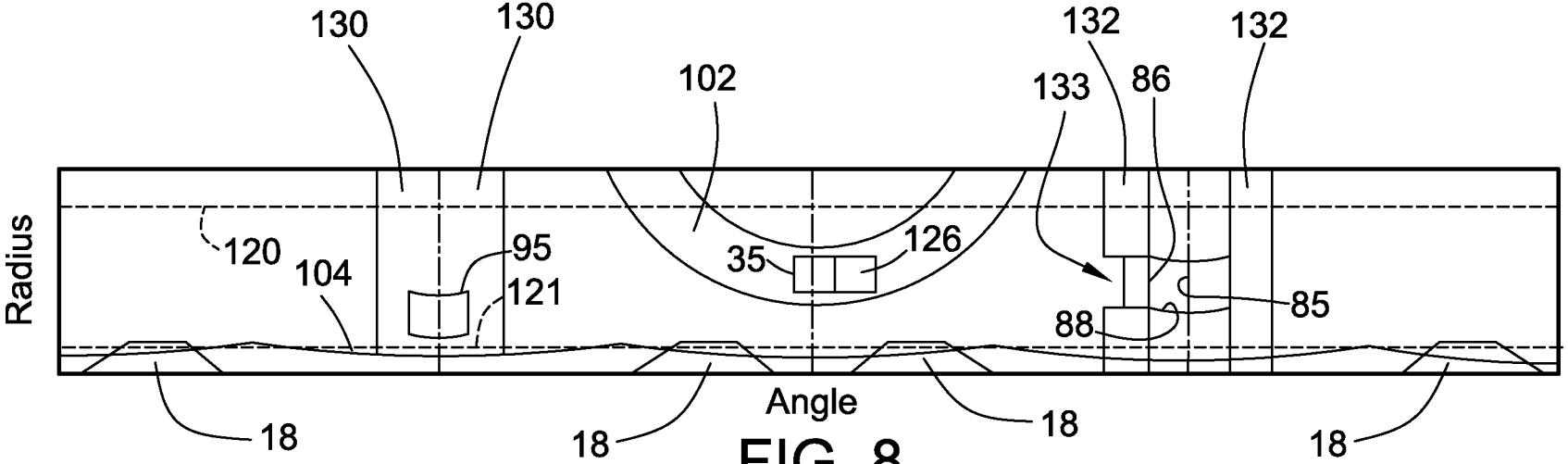
FIG. 8 depicts an exemplary graph similar to FIG. 5 but further depicting a stopping zone for the work implement and auto-lift zones for certain obstacles.
Figure 9:
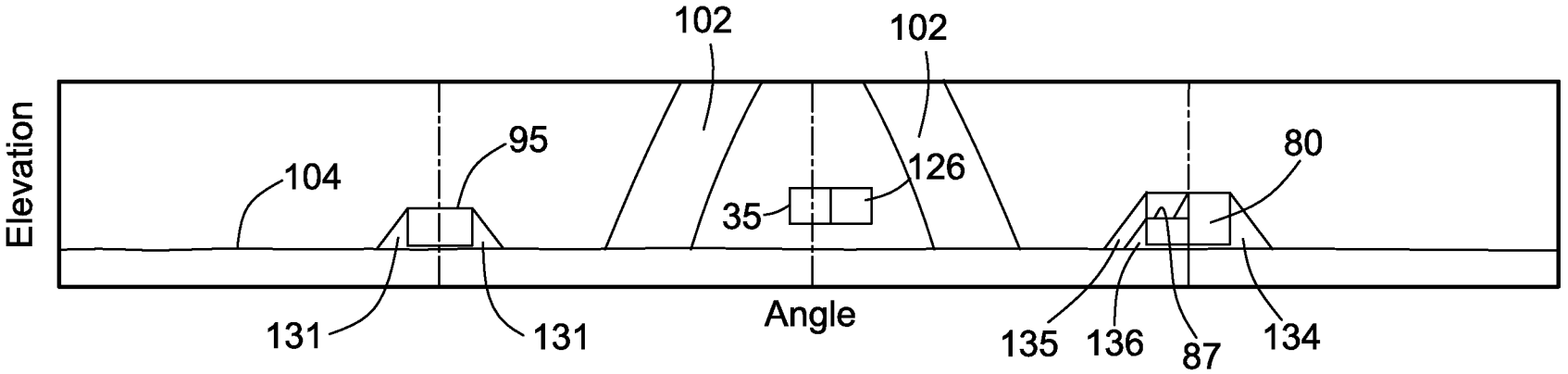
FIG. 9 depicts an exemplary graph similar to FIG. 8 but plotting the elevation is a function of angle in cylindrical coordinates.

The planning system 75 may also generate auto-lift zones within the electronic map adjacent obstacles to provide an additional safety factor. More specifically, an auto-lift zone may be defined adjacent each obstacle so that if the dipper 35 or dipper handle 40 enters the zone, the controller 56 may automatically lift or raise the dipper in an attempt to raise the dipper over the obstacle rather than it continuing into contact with the obstacle. The size of each auto-lift zone may be a function of the obstacle, the payload within the dipper 35, and the velocity of the dipper. Referring to FIGS. 8-9, a first radial auto-lift zone 130 is positioned on opposite sides of the dozer 95 and a first elevation auto-lift zone 131 is positioned on opposite sides of the dozer.

If the dipper 35 approaches the dozer 95 from either direction as the dipper is being swung, it will approach the first radial auto-lift zone 130 (FIG. 8) and the controller 56 may generate commands to cause the dipper to be raised. If the dipper 35 is higher than the first elevation auto-lift zone 131 (FIG. 9), the dipper may pass over the dozer 95 without any action by the controller 56 or an operator. It should be noted that the elevation auto-lift zones are angled upward from the ground surface 104 since the urgency of raising the dipper 35 may be a function of the distance from the obstacle and the increase in elevation necessary to avoid the obstacle.

A second radial auto-lift zone 132 is positioned on opposite sides of the haul truck 80. An opening 133 extends partially through the second radial auto lift zone 132 in alignment with the dump body 84. A second elevation auto-lift zone 134 is positioned on opposite sides of the haul truck 80 and is associated with one of the second radial auto-lift zones 132 except along the opening 133. At the opening 133, a third elevation auto-lift zone 135 is positioned on the left side of the haul truck as viewed in FIGS. 8-9.

If the dipper 35 approaches the haul truck 80 from the right as viewed in FIGS. 8-9 as the dipper is being swung, it will approach the second radial auto-lift zone 132 (FIG. 8) to the right of the haul truck and the controller 56 may generate commands to cause the dipper to be raised. If the dipper 35 is higher than the second elevation auto-lift zone 134 (FIG. 9), the dipper may pass over the haul truck 80 without any action by the controller 56 or an operator.

If the dipper 35 approaches the haul truck 80 from the left as viewed in FIGS. 8-9 as the dipper is being swung and it is above the third elevation auto-lift zone 135 (FIG. 9) regardless of its radial position, the dipper may pass over the haul truck 80 without any action by the controller 56 or an operator. If the dipper 35 approaches the haul truck 80 from the left and is aligned with either of the second radial auto-lift zones 132, the controller 56 may determine whether the dipper is above the third elevation auto-lift zone 135. If the dipper is not above the third elevation auto-lift zone 135, the controller 56 may generate commands to cause the dipper to be raised.

If the dipper 35 approaches the haul truck 80 from the left and is aligned with the opening 133, the controller 56 may determine whether the dipper is above the fourth elevation auto-lift zone 136. If the dipper is not above the fourth elevation auto-lift zone 136, the controller 56 may generate commands to cause the dipper to be raised.

Figure 3:
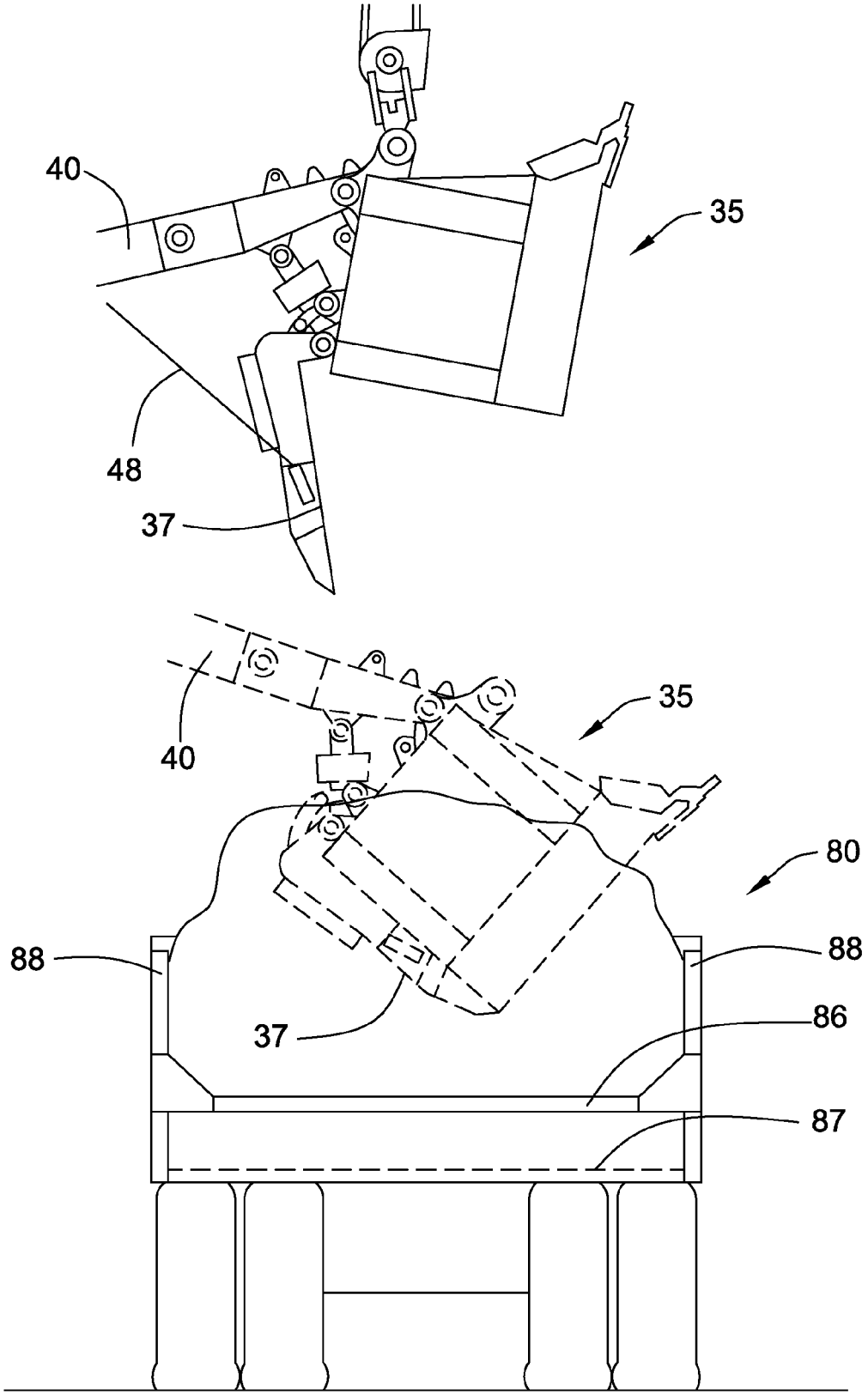
FIG. 3 depicts a diagrammatic illustration of a portion of the machine of FIG. 2 dumping a load of material into a haul truck.

In order to improve the material moving process (regardless of whether it is being performed autonomously, semi-autonomously, or manually), a re-spotting or re-positioning system, indicated generally at 76 in FIG. 2, may be provided to identify instances in which it is desirable to re-position a haul truck 80 prior to dumping a load of material. For example, it may be desirable for the dipper 35 to enter the space or target zone at the dump body 84 by moving over the rear wall 86 with the dipper at an angle and between the sidewalls 88 as depicted in phantom in FIG. 3. Still further, it may be desirable for a lower portion of the dipper 35 to travel or pass over the rear wall 86 but be positioned lower than an upper surface of the sidewalls 88 as depicted in FIG. 3. As such, the window or target into which it is desired to move the dipper 35 may be relatively small.

Figure 10:
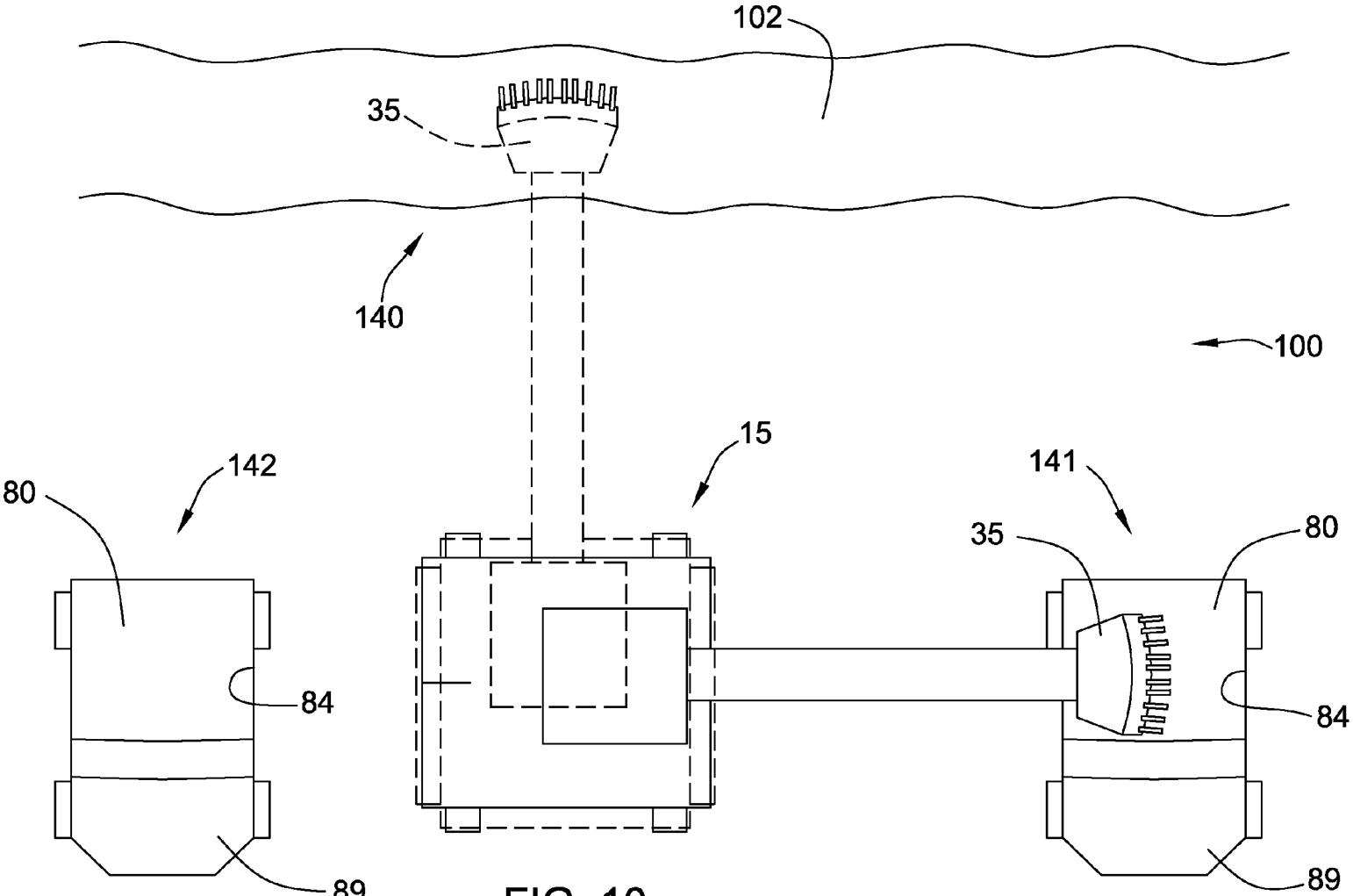
FIG. 10 depicts a schematic view similar to FIG. 4 but utilizing a 2nd haul truck.
Figure 11:
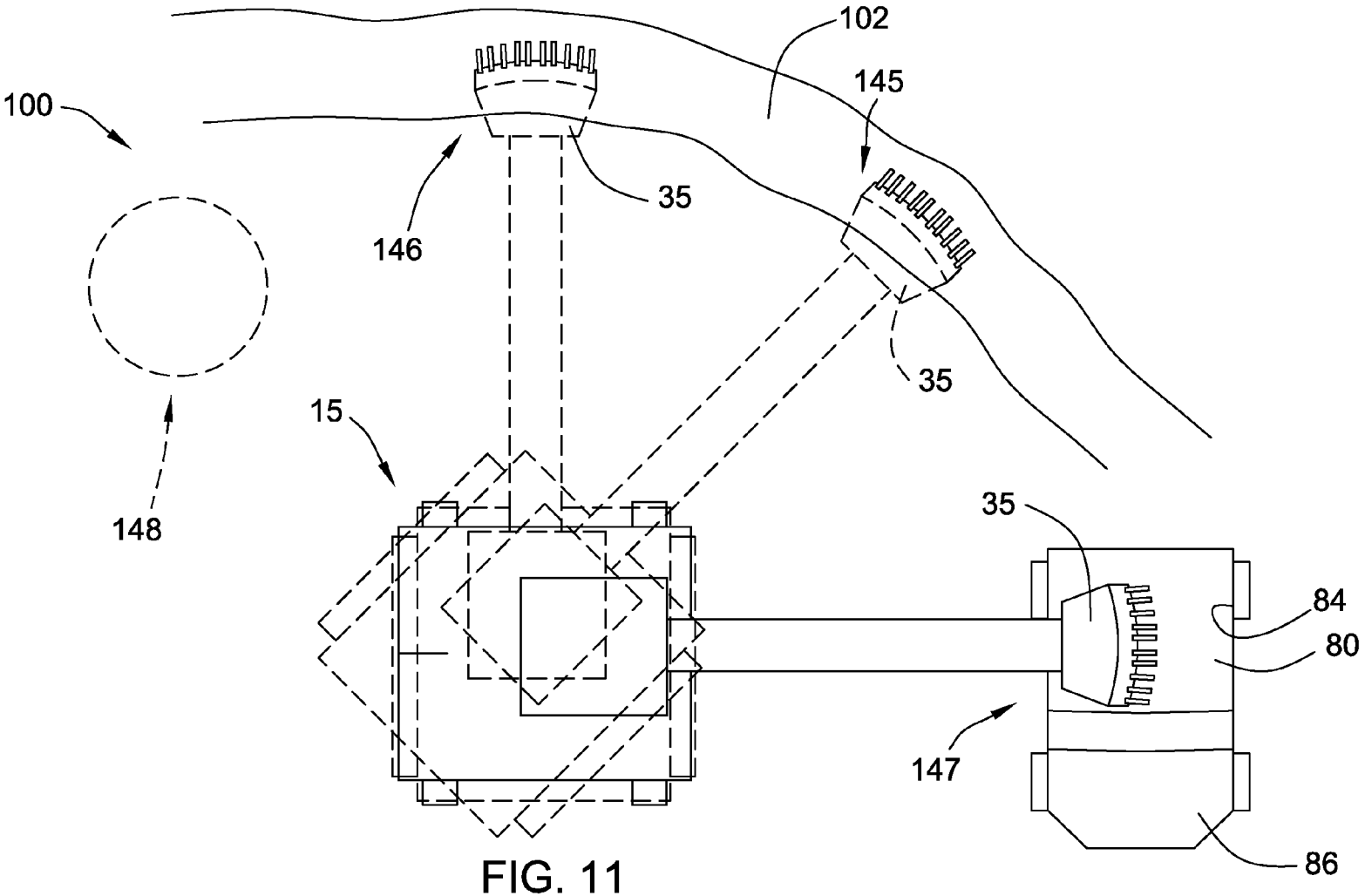
FIG. 11 depicts a schematic view similar to FIG. 4 but utilizing a 2nd dig location.

In some instances it may be desirable to generally center the dipper 35 between the front wall 85 and rear wall 86 of the dump body but position the dipper closer to the sidewall closest to the rope shovel 15 as depicted in FIGS. 10-11. Upon beginning the dumping process, the controller 56 may generate commands to pull the actuator cable 48 and also extend or crowd out the dipper handle 40 to further increase the force applied to the actuator cable. By positioning the dipper 35 closer to the sidewall 88 nearest the rope shovel 15, the dipper may be crowded out without engaging the sidewall farthest from the rope shovel.

The re-positioning system 76 may be configured to analyze the pose of a haul truck 80 and the pose and kinematic model or capabilities of the rope shovel 15, as well as the location of any additional obstacles at the work site 100, to determine whether the dipper 35 may be efficiently and/or safely moved to the target zone at the dump body 84 and dumped or whether it is desirable to re-position of the haul truck prior to dumping. For example, the controller 56 may determine a plurality of paths that the dipper 35 may travel from its current location (as determined by the pose of the rope shovel 15) to the target zone at the dump body 84 based upon the kinematic model of the implement system and the desired operating characteristics of the implement system.

In one example, the haul truck 80 may be too close to the base 16 of rope shovel 15 (i.e., within keep-out zone 121) so that rotation of the base during the loading process would cause a collision or the dipper 35 cannot be maneuvered into the desired loading position generally centered between the front wall 85 and rear wall 86 in a first direction and between the sidewalls 88 in a second direction, with the second direction being generally perpendicular to the first direction.

In another example, the haul truck 80 may be too far away from the rope shovel 15 so that the dipper 35 may not be centered relative to the dump body 84 even if the dipper handle 40 is fully extended or crowded out (i.e., outside the outer limit 120 of the reach of the dipper). In still another example, the haul truck 80 may be positioned too far forward or too far rearward and at an angle such that the dipper 35 cannot enter the target zone or space above the dump body 84 along the center of the rear wall 86 (FIG. 3).

In a further example, the haul truck 80 may be positioned at a location in which the dipper 35 may be positioned as desired above the dump body 84 but the haul truck is positioned at a location relatively far from the dig location. In such case, it may be desirable to re-position the haul truck 80 so that the time spent by the rope shovel 15 swinging between the dig and dump positions is reduced, thus increasing the efficiency of the material loading process.

If the re-positioning system 76 analyzes the pose of the haul truck 80 and the pose and kinematic model of the rope shovel 15 (or the pose of the boom 25) and determines that it is desirable to re-position the haul truck 80, the operator of the haul truck may be instructed to re-position the haul truck at a new location or a new orientation.

In some instances, the re-positioning system 76 may be configured to operate based upon the position or pose of any portion of the implement system together with the kinematic model of the implement system without the pose of the entire rope shovel 15 or even the pose of the dipper 35. In doing so, the controller 56 may determine the position or pose of a portion of the implement system and determine all possible locations for the dipper 35 based upon the position of the portion of the implement system. The controller 56 may then analyze potential paths of the dipper 35 to the target zone based for each of the possible locations of the dipper 35 together with the kinematic model of the implement system and the desired operating characteristics of the implement system. For example, if the position of the boom 25 is known, the controller 56 may determine all possible positions for the dipper 35 and the dipper handle 40. The controller may then determine potential paths of the dipper 35 to the target zone based upon each possible position of the dipper.

The instructions to re-position the haul truck 80 may take any desired form. In one example, the instructions may be provided as an alert command between the controller 56 of rope shovel 15 and controller 91 of haul truck 80. The instructions may result in a written communication on a display within the haul truck 80, another type of visual indication such as flashing certain lights of the haul truck, or an audible communication or indication such as by generating a verbal request or sounding a horn or an alarm of the haul truck. In another example, the rope shovel 15 may generate an alert commands as visual or audible indications such as flashing lights or sounding an alarm on the rope shovel.

When dumping or unloading a load of material from dipper 35, in some instances, it may be desirable to position the dipper at a specified or predetermined distance above the dump body 84 to reduce or minimize the distance that material falls as it fills the dump body. By reducing or minimizing distance that the material falls, the impact of the material on the haul truck 80 is reduced, which reduces wear on the haul truck 80 and fatigue on the truck operator.

If the dipper 35 is positioned the predetermined distance above the lower surface 87 of the dump body 84 when the dump body is empty, as the dump body is filled with material, the dump height of the dipper must be increased if it is desired to maintain the relative dump height (i.e., the distance the material falls) to compensate for the additional material. In other words, if it is desirable to maintain a specified distance that the material falls into the dump body 84, the height of the dipper 35 during the dumping process must be sequentially increased after each dumping cycle due to the addition of material into the dump body.

Referring to the height of the surface upon which the material is being dumped as the bed height, the lower surface 87 may define the initial bed height. As each load of material is added to the dump body 84, the additional material changes the effective bed height (i.e., the height of the upper surface upon which the next load may be dumped). Accordingly, to maintain the desired relative dump height, it may be desirable to increase the absolute position of the dipper 35 relative to the ground surface 104.

Control system 55 may include a dump height positioning system, indicated generally at 77 in FIG. 2, that operates to determine a desired height of the dipper 35 at which each dumping or unloading operation should occur. The dump height positioning system 77 may control the dump height when performing material moving operations autonomously or semi-autonomously and may be used to suggest a dump height when operating the rope shovel 15 manually.

In operation, the dump height positioning system 77 may first determine the height of the lower surface 87 of the dump body 84 relative to ground surface 104. In one example, the perception sensors 71 of the terrain mapping system 70 may be high enough to determine the height of the lower surface 87 relative to the ground surface 104 (i.e., the bed height). In another example, the position of the lower surface 87 may be determined from the pose of the haul truck 80 together with known machine dimensions such as those associated with an identifying code for the haul truck as discussed above.

After determining the height of the lower surface 87, the dipper 35 may be moved to the desired position (i.e., at the desired height above the lower surface and generally centered relative to the dump body 84) and the door 37 of the dipper opened to dump the material. The addition of material on top of the lower surface 87 of dump body 84 will likely increase the effective bed height. The dump height positioning system 77 may determine or estimate a new effective bed height in any desired manner. In one example using a closed loop system, the perception sensors 71 may be utilized to determine the new effective bed height. In another example using a closed loop system, additional mapping or perception sensors, indicated generally at 79, may be provided at the dipper 35 or dipper handle 40 and operate in a manner similar to the perception sensors 71 to determine the effective bed height.

In an example using an open loop system, the dump height positioning system 77 may estimate the new effective bed height based upon the dimensions or capacity of the dipper 35 and the dimensions or capacity of the dump body 84 of haul truck 80. In a further example using an open loop system, the dump height positioning system 77 may estimate the new effective bed height by raising the previous effective bed height by a predetermined increment or distance.

Upon determining or estimating a new effective bed height, a new dump height may be determined based upon the new effective bed height and the relative dump height. The dipper 35 may be moved to its desired position above the dump body 84 and the material dumped into the haul truck 80. The process of determining or estimating a new or subsequent effective bed height, a new or subsequent dump height, and performing a material moving operation may be repeated until the haul truck 80 is filled to the desired level.

It should be noted that in some instances, the dump height positioning system 77 may determine a new dump height by raising the previous dump height based upon the dimension of the dipper and the dimensions of the dump body 84 rather than estimating a new effective bed height by raising the previous effective bed height by a predetermined increment and then calculating a new dump height.

In another example, the dump height positioning system 77 may operate by determining a first or initial dump height based upon the initial bed height and increasing the dump height by a predetermined amount after each dump process until the dump body 84 is full. In one example, the predetermined amount that the dump height is increased for each subsequent cycle may be generally identical. In another example, the predetermined amount that the dump height is increased for each subsequent cycle may be different. In instances in which more than three dump cycles are used for a haul truck 80, the predetermined distances may be generally identical, different, or a combination.

Upon dumping each load of material, the rope shovel 15 may be operated to return the dipper 35 to a desired dig location. This process may be referred to as a return-to-dig process and may be performed autonomously, semi-autonomously, or manually. When operating autonomously or semi-autonomously, a return-to-dig system, indicated generally at 78 in FIG. 2, may be configured to move the dipper 35 sequentially between one or more dig locations and one or more dump locations. The dig locations may be set automatically, by an operator, or other personnel. In addition, the desired sequence may be set automatically, by an operator, or other personnel.

In one example depicted in FIG. 10, a material moving operation may be configured with a single rope shovel 15 operating at a single dig location 140 together with a first loading or dump location 141 and a second loading or dump location 142 at which haul trucks 80 may be loaded. The first dump location 141 and the second dump location 142 may be positioned at any location but are depicted in FIG. 10 on opposite sides of the rope shovel 15.

During a material loading operation, material may be loaded into the dipper 35 at the dig location 140 and the dipper moved into alignment with a first haul truck 80 located at the first dump location 141 and unloaded. Upon emptying the dipper 35, the controller 56 may generate command signals to move the dipper back to the dig location 140 and the process of loading the first haul truck 80 may be repeated until the first haul truck is fully loaded.

Either before or while the rope shovel 15 is loading the first haul truck 80, a second haul truck may be positioned at the second dump location 142. Once the first haul truck 80 is fully loaded, the first haul truck may depart the first dump location 141 and the dipper 35 returned to the dig location 140 to begin another dipper loading and unloading cycle. After loading the dipper 35, the dipper may be moved into alignment with the second haul truck 80 located at the second dump location 142 and unloaded. Upon emptying the dipper 35, the dipper may be moved back to the dig location 140 and the process of loading the second haul truck 80 is repeated until the second haul truck is fully loaded. Either before or while the rope shovel 15 is loading the second haul truck 80, an empty haul truck may be positioned at the first dump location 141 and the loading process may be repeated at the first dump location once the second haul truck is fully loaded. With the configuration depicted in FIG. 10, the rope shovel 15 may be continuously operated by positioning an empty haul truck 80 at either the first dump location 141 or the second dump location 142 while the rope shovel is loading a haul truck at the other dump location.

In a second example depicted in FIG. 11, a material moving operation may be configured with a rope shovel 15 digging at both a first dig location 145 and a second dig location 146 and dumping at a single dump location 147. The first dig location 145 may be located generally near or adjacent the dump location 147 and the second dig location 146 located farther from the dump location.

During a material loading operation, material may be loaded into the dipper 35 at the first dig location 145 and the dipper moved into alignment with a haul truck 80 located at the dump location 147 and unloaded. Upon emptying the dipper 35, the controller 56 may generate command signals to move the dipper back to the first dig location 145 and the process of loading the haul truck 80 may be repeated until the haul truck is fully loaded. Once the haul truck 80 is fully loaded, the haul truck may depart the dump location 147 and an empty haul truck positioned at the dump location.

While the loaded haul truck 80 is leaving the dump location 147 and the empty haul truck is being positioned at the dump location, the dipper 35 may be moved to the second dig location 146 and material loaded into the dipper. The dipper 35 may be moved back to the dump location 142 to fill the newly positioned empty haul truck 80. Upon emptying the dipper 35, the dipper may be moved to the first dig location 140 and the process of digging at the first dig location and loading the haul truck 80 at the dump location 147 may be repeated until the haul truck is fully loaded. With the configuration depicted in FIG. 11, the time required to move the fully loaded haul truck 80 from the dump location 147 and position an empty haul truck thereat may be utilized more efficiently by directing the rope shovel 15 to load the dipper 35 at the second dig location 146, which is located farther from the dump location as compared to the first dig location 145.

In a further example, a configuration may be utilized that is similar to that of FIG. 11 but includes a second dump location, indicated generally at 148, near the second dig location 146. By adding the second dump location 148, the rope shovel 15 may load a haul truck at each dump location and then dig material at a dig location near each dump location.

The positions of the dig locations may be set in any desired manner. In one example, the dig locations may be set by an operator manually moving the dipper to a desired location and actuating an input device such as a switch (not shown) within the operator station 20. The signals from the sensors (e.g., swing sensor 62 and crowd sensor 65) indicative of the general position of the desired dig location may be stored within controller 56 to subsequently identify the desired dig location. The process may be repeated for each dig location.

In another example, the desired dig locations may be set or stored by entering the control system 55 into a learning mode and an operator operating the rope shovel 15 to perform a digging operation. Upon performing the digging operation, the controller 56 may determine the swing position from swing sensor 62 and the crowd from crowd sensor 65 and store the positions to subsequently identify the desired dig location.

In still another example, the desired dig locations may be set or stored by identifying the locations on the electronic map stored within controller 56. More specifically, an operator may identify or input desired dig locations on a display device within the operator station 20.

Figure 13:
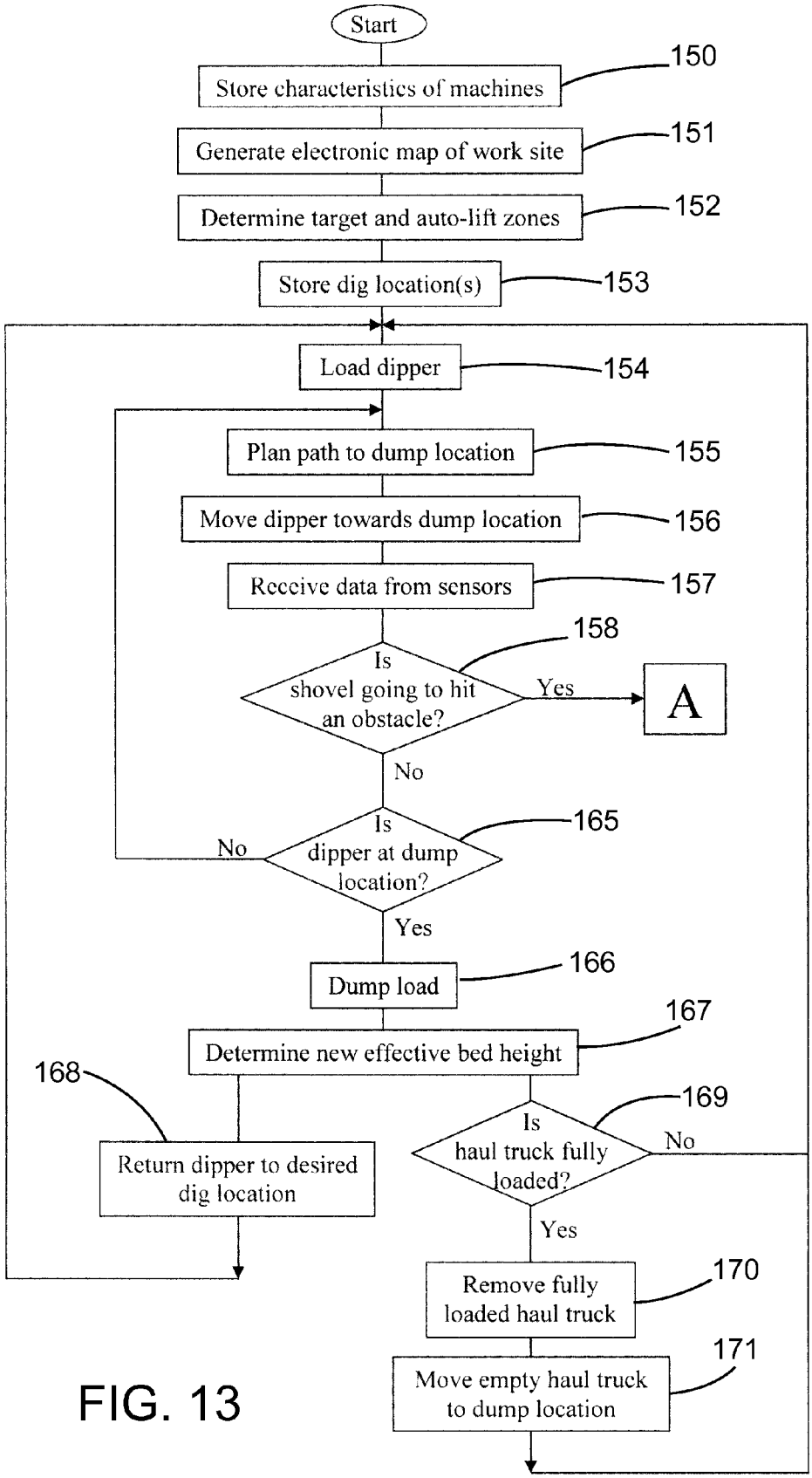
FIG. 13 depicts a flowchart illustrating a material moving process in accordance with the disclosure.
Figure 14:
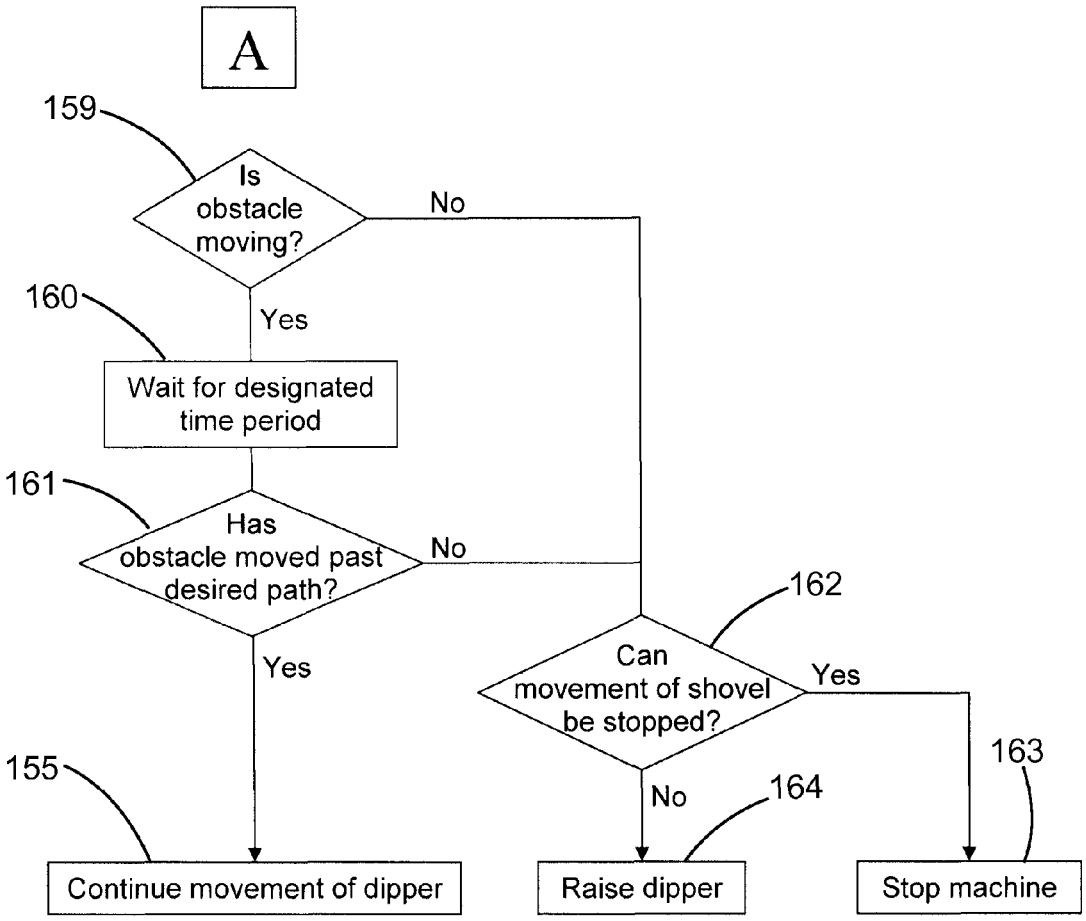
FIG. 14 depicts a flowchart illustrating a further aspect of the material moving process of FIG. 13.

Referring to FIGS. 13-14, flowcharts of a semi-autonomous material moving operation using rope shovel 15 is depicted. The flowcharts depict a process in which an operator may manually perform a digging operation and the controller 56 of rope shovel 15 semi-autonomously moves the dipper 35 into alignment with a haul truck 80, dumps the load within the dipper, and returns the dipper to a dig location at which the operator may perform a new digging operation. At stage 150, characteristics of the machines operating at the work site 100 may be entered into controller 56. The characteristics may include operating capacities, dimensions, desired operating characteristics, and other desired or necessary information. Examples may include the kinematic model of the rope shovel 15 and the dimensions of the haul trucks 80.

An electronic map of the work site 100 may be generated at stage 151. In one example, the electronic map may be created by the terrain mapping system 70. The perception sensors 71 may generate mapping signals that are received by controller 56 and the controller may convert the mapping signals into an electronic map of the work site 100. The electronic map may include representations that depict the positions of face 102, ground surface 104, and the rope shovel 15. In addition, each of the obstacles located by the terrain mapping system 70 and/or identified by the object identification system 73 may be included in the electronic map.

While the electronic map may be generated and stored in a rectangular or Cartesian coordinate system, it may be desirable to convert and/or store the electronic map in a cylindrical coordinate system. Storing the electronic map in a cylindrical coordinate system with the map centered about axis 22 may simplify the generation of command signals by the controller 56, the operation of the planning system 75, and the determination of whether a portion of the rope shovel 15 is likely to come into contact with an obstacle.

At stage 152, the controller 56 may determine the position or pose of the target zone 124 including the height of the lower surface 87 of the dump body 84 relative to ground surface 104 and store the information within the electronic map of the controller 56. The position or pose of the target zone may be determined based upon information from the terrain mapping system 70, the pose sensing system 92, other mapping or perception systems, information from a data map stored within any controller, and/or any other desired systems.

Auto-lift zones around each obstacle may also be determined and stored within the electronic map at stage 152.

One or more dig locations may be set or stored at stage 153 within controller 56. The dig locations may be identified and stored within controller 56 in any desired manner. In one example, an operator may move the dipper 35 to a desired dig location and actuate an input device such as a switch (not shown) within the operator station 20. Signals from the sensors (e.g., swing sensor 62, hoist sensor 63, and crowd sensor 65) indicative of the position of the desired dig location may be stored within controller 56.

At stage 154, the dipper 35 may be loaded with material such as from the face 102 of the mine 101 (FIG. 1). It should be noted that the operation of stages 153 and 154 may be reversed or may occur simultaneously depending upon the manner in which the dig location(s) are stored. The planning system 75 may plan at stage 155 a desired path to the dump location. More specifically, the planning system 75 may determine the desired path for the dipper to travel from to the target zone 124 at the dump body 84 of the haul truck 80. Upon initially loading the dipper 35, the planning system 75 may determine the desired path from the dig location to the dump location. As the dipper 35 moves towards the dump location, the controller 56 may concurrently determine and update the desired path of the dipper from its current location to the target zone 124.

While determining the path of the dipper 35, the controller 56 may also determine the stopping zone 126 of the dipper 35. Since the stopping zone 126 is generally a function of the momentum of the rope shovel 15, the length of the stopping zone will typically increase as the rope shovel moves more rapidly. It should be noted that by avoiding obstacles that are radially between the dipper 35 and the base 16, the likelihood of contact between an obstacle and any portion of the rope shovel 15 is reduced.

The controller 56 may generate at stage 156 command signals to move the dipper 35 along the identified or predetermined path towards the target zone 124. While moving the dipper 35, the controller 56 may receive at stage 157 data from the sensors associated with the rope shovel 15 together with any sensors associated with the obstacles and the work site 100 to update the electronic map of the work site. Based upon the position, speed, and acceleration of the rope shovel 15 as well as the obstacles adjacent the rope shovel, the controller 56 may determine at decision stage 158 whether the rope shovel is likely to make contact with an obstacle as the dipper moved towards the target zone 124.

If the rope shovel 15 is likely to contact an obstacle, the controller 56 may determine at decision stage 159 (FIG. 14) whether the obstacle is moving. If the obstacle is moving, the controller 56 may pause or wait at stage 160 for a predetermined period of time in case the obstacle moves sufficiently out of the path of the rope shovel 15. If the obstacle has moved sufficiently so that contact or a collision between the rope shovel 15 and the obstacle may be avoided, movement of the dipper 35 may be continued by referring back to FIG. 13 at stage 155.

If the obstacle is not moving at decision stage 159 or has not moved out of the path within the predetermined time period at decision stage 161, controller 56 may determine at decision stage 162 whether movement of the rope shovel 15 may be stopped within a sufficient distance or time period to avoid a collision with the obstacle. If the rope shovel 15 may be stopped without a collision, the controller 56 may generate commands to stop the machine at stage 163. If the rope shovel 15 may not be stopped without a collision, the controller 56 may generate commands at stage 164 to raise the dipper 35 in an attempt to pass over the obstacle.

If the rope shovel 15 is not going to contact an obstacle, the controller 56 may determine at decision stage 165 whether the dipper 35 is sufficiently aligned with the target zone 124 including being positioned as desired at the dump body 84 and positioned at the desired dump height above the lower surface 87 of the dump body. If the dipper 35 is not sufficiently aligned with the target zone 124 and at the desired dump height, the dipper may continue to be moved towards the desired position and stages 155-8, 165 repeated.

If the dipper 35 is aligned with the target zone 124 and at the desired dump height, the controller 56 may dump at stage 166 the load of material into the dump body 84. To do so, the controller 56 may generate a command to actuate the door actuator motor 49 which engages actuator cable 48 to open the door 37.

At stage 167, the controller 56 may determine the new effective bed height of the dump body 84. To do so, the controller 56 may utilize perception sensors 71, additional sensors 79, an estimate of the change in bed height due to the addition of material into the dump body 84, or any other desired system or process. At stage 168, the controller 56 may generate commands to return the dipper 35 to a desired dig location and stages 154-168 repeated.

While the dipper 35 is being returned to the desired dig location, the controller 56 may determine at decision stage 169 whether the haul truck 80 is fully loaded. In one embodiment, the controller 56 may make such a determination based upon the analysis of the new effective bed height of the dump body 84. In another embodiment, a load sensing system 93 of haul truck 80 may be used to determine when the haul truck is fully loaded. If the haul truck 80 is not fully loaded, the haul truck may remain in place and the material moving process may be continued and stages 154-169 repeated.

If the haul truck 80 is fully loaded, the haul truck may be moved at stage 170 from the dump location and transported to a desired location spaced from the dump location. Once the fully loaded haul truck 80 has been moved from the dump location, an empty haul truck may be moved at stage 171 to the dump location and the material moving process may be continued and stages 154-169 repeated.

Figure 12:
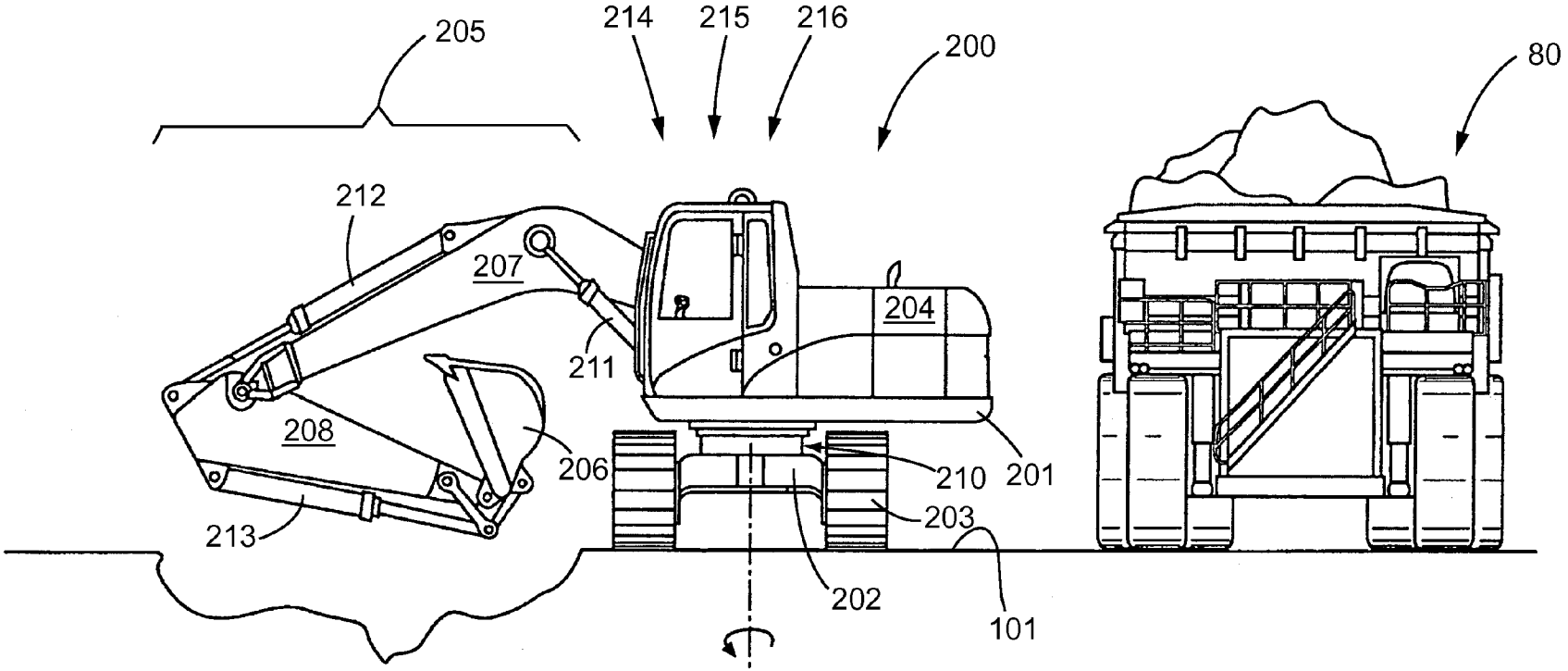
FIG. 12 depicts a diagrammatic illustration of an excavator and a haul truck in accordance with the disclosure.

Although described in the context of rope shovel 15, many of the concepts disclosed herein are applicable to other similar machines and systems. For example, FIG. 12 depicts an excavator 200 having multiple systems and components that may cooperate to move material from a dig location to a dump location. Excavator 200 may include a platform 201 rotatably disposed on undercarriage 202. Undercarriage 202 may include one or more ground engaging drive mechanism such as tracks 203.

Platform 201 may include a prime mover 204 operative to power an implement system 205 including a work implement or tool such as bucket 206. Prime mover 204 may provide a rotational output to drive tracks 203, thereby propelling the excavator 200. Prime mover 204 may also provide power to other systems and components of the excavator 200.

The implement system 205 may include a boom 207, a connecting member or stick 208, and a work implement or tool. A first end of boom 207 may be pivotally connected to platform 201, and a second end of the boom may be pivotally connected to a first end of stick 208. The work implement or tool such as bucket 206 may be pivotally connected to a second end of stick 208.

Rotation of platform 201 relative to undercarriage 202 may be effected by a swing motor 210. Each linkage member may include and be operatively connected to one or more actuators such as hydraulic cylinders. More specifically, boom 207 may be propelled by one or more boom hydraulic cylinders 211 (only one being shown in FIG. 12). Stick 208 may be propelled by a stick hydraulic cylinder 212. Rotation of the bucket 206 relative to the stick 208 may be effected by a work implement hydraulic cylinder 213.

Each of the swing motor 210, boom hydraulic cylinders 211, stick hydraulic cylinder 212, and work implement hydraulic cylinder 213 may be driven by a hydraulic system, generally indicated at 214, that may be powered by the prime mover 204. Excavator 200 may include a control system 215 and a controller 216 similar to those of rope shovel 15.

Excavator 200 may also include systems and sensors for efficient operation of the machine. Such systems and sensors may be similar to or result in similar measurements and functionality to the systems and sensors of rope shovel 15. As non-limiting examples, the mapping system 70 of rope shovel 15 may be used with excavator 200 to generate an electronic map of the work site 100 and store the electronic map within controller 216 in either rectangular or cylindrical coordinates. Re-positioning system 76 may also be used with excavator 200 to identify instances in which the excavator may not efficiently or safely load a haul truck 80 that is positioned near the excavator. In addition, dump height positioning system 77 may be used with excavator 200 in instances in which it is desired to control the height at which the bucket 206 is dumped. Finally, return-to-dig system 78 may be used with excavator 200 in instances in which it is desired to utilize a return-to-dig process that includes automated movement between a plurality of either dig locations or dump locations.

From the forgoing, it may be understood that each of the rope shovel 15 and the excavator 200 includes a base rotatably mounted on an undercarriage having a ground engaging drive mechanism. Each of the rope shovel 15 and the excavator 200 also includes an implement system or linkage assembly mounted on the base. Each implement system includes a boom secured to the base although the boom 25 of the rope shovel is fixed while the boom 207 of the excavator is pivotably mounted to the base or platform 201. Each of the rope shovel 15 and the excavator 200 further includes a ground engaging work implement in the form of a dipper 35 or bucket 206, respectively. The dipper 35 is fixed to dipper handle 40 which is operatively connected to the boom 25 while the bucket 206 is pivotably mounted on the stick 208.

INDUSTRIAL APPLICABILITY

The industrial applicability of the systems described herein will be readily appreciated from the foregoing discussion. The present disclosure is applicable to many machines and tasks performed by machines. Exemplary machines include rope shovels, hydraulic mining shovels, excavators, and backhoes.

A re-positioning system 76 may be used to identify instances in which the excavator may not efficiently or safely load a haul truck 80 that is positioned near a machine such as rope shovel 15. A dump height positioning system 77 may be used when it is desired to control the height at which the bucket 206 is dumped. A return-to-dig system 78 may be used when it is desired to move a work implement such as dipper 35 from a dump location to one or more dig locations in an automated manner.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for setting a dump height of a material engaging work implement above a dump body comprising:

a rotatable implement system at a work site having a linkage assembly including the work implement;

an implement system pose sensor for generating implement system pose signals indicative of a pose of the implement system including a pose of the work implement;

the dump body having a lower surface, the lower surface defining an initial bed height onto which material is dumped from the work implement;

a bed height sensor for generating bed height signals indicative of a bed height of the dump body; and a controller configured to:

store a relative dump height;

determine the initial bed height based upon the bed height signals while the dump body is empty;

determine an initial dump height at which the work implement is to be positioned over the dump body based upon the initial bed height and the relative dump height;

generate a command based upon the pose of the work implement to position the work implement at the initial dump height over the dump body and dump material into the dump body;

determine a subsequent dump height, the subsequent dump height being higher than the initial dump height;

generate a command based upon the pose of the work implement to position the work implement at the subsequent dump height over the dump body and dump material into the dump body;

determine a further subsequent dump height with the further subsequent dump height being higher than the subsequent dump height; and generate a command based upon the pose of the work implement to position the work implement at the further subsequent dump height over the dump body and dump material into the dump body.

2. The system of claim 1, wherein the controller is further configured to continue to determine still further subsequent dump heights with each still further subsequent dump height being higher than an immediately preceding dump height, and generate a command to position the work implement at the still further subsequent dump height over the dump body and dump material.

3. The system of claim 2, wherein the controller is configured to continue to determine the still further subsequent dump heights and dump material in the dump body until the dump body is full.

4. The system of claim 1, wherein controller is further configured to determine the subsequent dump height and the further subsequent dump height based upon a closed loop system.

5. The system of claim 4, wherein controller is further configured to determine a subsequent bed height and a further subsequent bed height based upon the closed loop system, determine the subsequent dump height based upon the subsequent bed height, and determine the further subsequent dump height based upon the further subsequent bed height.

6. The system of claim 5, further including a mapping sensor, the mapping sensor being operative as the bed height sensor, and the controller is configured to determine the subsequent bed height and the further subsequent bed height based upon mapping signals from the mapping sensor.

7. The system of claim 6, wherein the mapping sensor is positioned at the work implement.

8. The system of claim 1, wherein controller is further configured to determine the subsequent dump height by increasing the initial dump height by a first predetermined distance and determine the further subsequent dump height by increasing the subsequent dump height by a second predetermined distance.

9. The system of claim 8, wherein the first predetermined distance and the second predetermined distance are generally identical.

10. The system of claim 8, wherein the first predetermined distance and the second predetermined distance are different distances.

11. The system of claim 1, wherein controller is further configured to determine the subsequent dump height and the further subsequent dump height based upon an open loop system.

12. The system of claim 11, wherein controller is further configured to determine a subsequent bed height and a further subsequent bed height based upon an open loop system, determine the subsequent dump height based upon the subsequent bed height, and determine the further subsequent dump height based upon the further subsequent bed height.

13. The system of claim 1, further including a pose sensor associated with the dump body for generating pose signals indicative of a position of the dump body, and the pose sensor is operative as the bed height sensor.

14. The system of claim 1, further including a rotatable base having a linkage assembly, the linkage assembly including a boom operatively connected to the rotatable base, a connecting member operatively connected to the boom, and the work implement.

15. The system of claim 14, further including a mapping sensor mounted on the rotatable base and operative as the bed height sensor.

16. The system of claim 1, wherein the controller is further configured to store an electronic map including the implement system, the dump body, and the work site in cylindrical coordinates.

17. A controller implemented method of setting a dump height of a material engaging work implement above a dump body, the method comprising:

providing the material engaging work implement, the work implement being operatively connected to a rotatable implement system having a linkage assembly;

providing the dump body, a lower surface of the dump body defining an initial bed height onto which material is dumped from the work implement;

storing a relative dump height;

determining the initial bed height based upon bed height signals from a bed height sensor while the dump body is empty;

determining an initial dump height at which the work implement is to be positioned over the dump body based upon the initial bed height and the relative dump height;

generating a command based upon a pose of the work implement to position the work implement at the initial dump height over the dump body and dump material into the dump body;

determining a subsequent dump height, the subsequent dump height being higher than the initial dump height;

generating a command based upon the pose of the work implement to position the work implement at the subsequent dump height over the dump body and dump material into the dump body;

determining a further subsequent dump height with the further subsequent dump height being higher than the subsequent dump height; and generating a command based upon the pose of the work implement to position the work implement at the further subsequent dump height over the dump body and dump material into the dump body.

18. The method of claim 17, further including determining the subsequent dump height and the further subsequent dump height based upon a closed loop system.

19. The method of claim 17, further including determining the subsequent dump height and the further subsequent dump height based upon an open loop system.

20. A machine for use with a system for setting a dump height of a material engaging work implement, the system including a body having a lower surface, the lower surface defining an initial bed height onto which material is dumped from a work implement, and a bed height sensor associated with the dump body for generating bed height signals indicative of a bed height of the dump body, the machine comprising:

a rotatable base;

a linkage assembly, the linkage assembly including a boom operatively connected to the rotatable base, a connecting member operatively connected to the boom, and a material moving work implement operatively connected to the connecting member;

an implement system pose sensor for generating implement system pose signals indicative of a pose of the implement system including a pose of the work implement; and a controller configured to:

store a relative dump height;

determine the initial bed height based upon the bed height signals while the dump body is empty;

determine an initial dump height at which the work implement is to be positioned over the dump body based upon the initial bed height and the relative dump height;

generate a command based upon the pose of the work implement to position the work implement at the initial dump height over the dump body and dump material into the dump body;

determine a subsequent dump height, the subsequent dump height being higher than the initial dump height;

generate a command based upon the pose of the work implement to position the work implement at the subsequent dump height over the dump body and dump material into the dump body;

determine a further subsequent dump height with the further subsequent dump height being higher than the subsequent dump height; and generate a command based upon the pose of the work implement to position the work implement at the further subsequent dump height over the dump body and dump material into the dump body.

* * * * *